United States Patent [19]

Eickmann

[11] Patent Number: 4,475,870

[45] Date of Patent: Oct. 9, 1984

[54] HYDRAULIC ARRANGEMENT

[76] Inventor: Karl Eickmann, 2420 Isshiki, Hayama-machi, Kanagawa-ken, Japan

[21] Appl. No.: 179,420

[22] Filed: Aug. 19, 1980

[51] Int. Cl.[3] ..... F04B 23/10; F04B 23/14

[52] U.S. Cl. ..... 417/206; 417/270; 417/273

[58] Field of Search ..... 417/203, 205, 206, 270, 417/273

[56] References Cited

U.S. PATENT DOCUMENTS

| | | | |
|---|---|---|---|
| 1,936,935 | 11/1933 | Feleh et al. | 417/206 |
| 2,382,452 | 8/1945 | Svenson | 417/206 |
| 2,394,285 | 2/1946 | Bovins | 417/203 |
| 2,605,707 | 8/1952 | Worlidge | 417/206 |
| 2,617,360 | 11/1952 | Barker | 91/501 |
| 2,653,543 | 9/1953 | Mott | 417/252 |
| 2,851,952 | 9/1958 | Lane | 417/206 |
| 3,614,267 | 10/1971 | Schultze | 417/273 |
| 3,679,328 | 7/1972 | Cattanach | 417/270 |
| 3,874,271 | 4/1975 | Eickmann | 91/491 |
| 4,105,369 | 8/1978 | McClocklin | 417/206 |

FOREIGN PATENT DOCUMENTS

| | | | |
|---|---|---|---|
| 967809 | 5/1975 | Canada | 417/214 |
| 2817459 | 12/1978 | Fed. Rep. of Germany | 91/488 |
| 586066 | 3/1947 | United Kingdom | 417/273 |
| 1302163 | 1/1973 | United Kingdom | 417/273 |

*Primary Examiner*—William L. Freeh

[57] ABSTRACT

A hydraulic arrangement has a housing which includes a first space of a definite first pressure and a second space with a lower second pressure. A primary pump supplies fluid under the first pressure into the first space to open the entrance ports into cylinders, which contain pistons therein, whereby the pistons are forced partially out of the cylinders and into the mentioned second space. In the second space the pistons are moved inwardly into the cylinders by an eccentric cam ring to supply a flow of fluid of a fourth pressure out of the outlet of the arrangement's housing.

In modified embodiments the arrangement is a pressure transmission, which takes in a third pressure to drive a motor in the arrangement which in turn drives the shaft with the eccentric cam and the unit then exits the fourth pressure, which might be a very high pressure of up to more than ten thousand pounds per square inch. Still other embodiments show in several modifications a device to reciprocate or oscillate exterior linear or rotary motors either permanently or stepwise in predetermined cycles. Working actions of machines or vehicles can so be driven and controlled by the arrangement without additional control facilities, when so desired.

2 Claims, 22 Drawing Figures

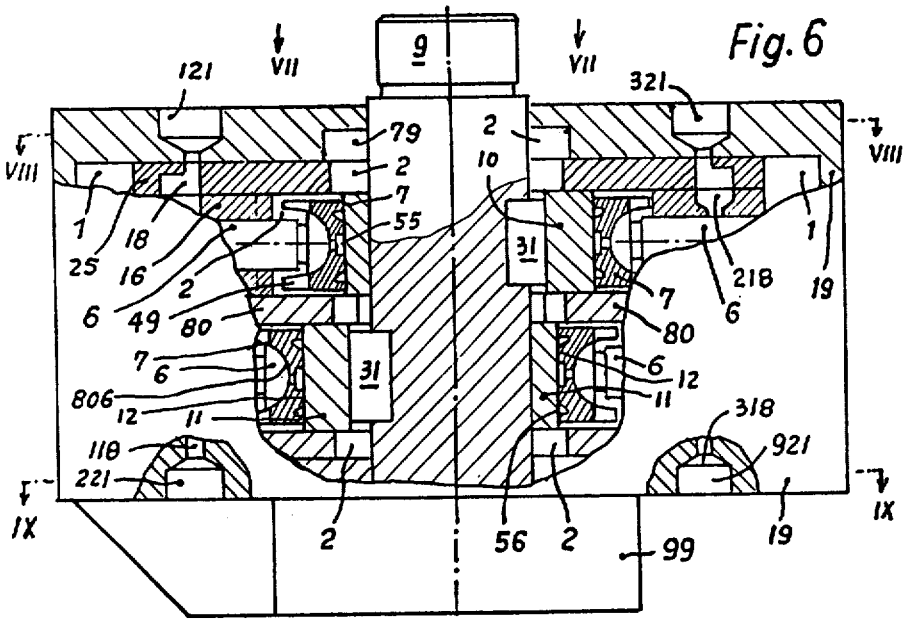
Fig. 6
9
VII
VII
121
321
79
2
10
VIII
VIII
2
7
55
1
18
25
16
2
6
49
80
31
7
6
806
12
11
118
221
IX
IX
2
56
2
99
19
1
218
19
7
6
80
6
12
11
318
921
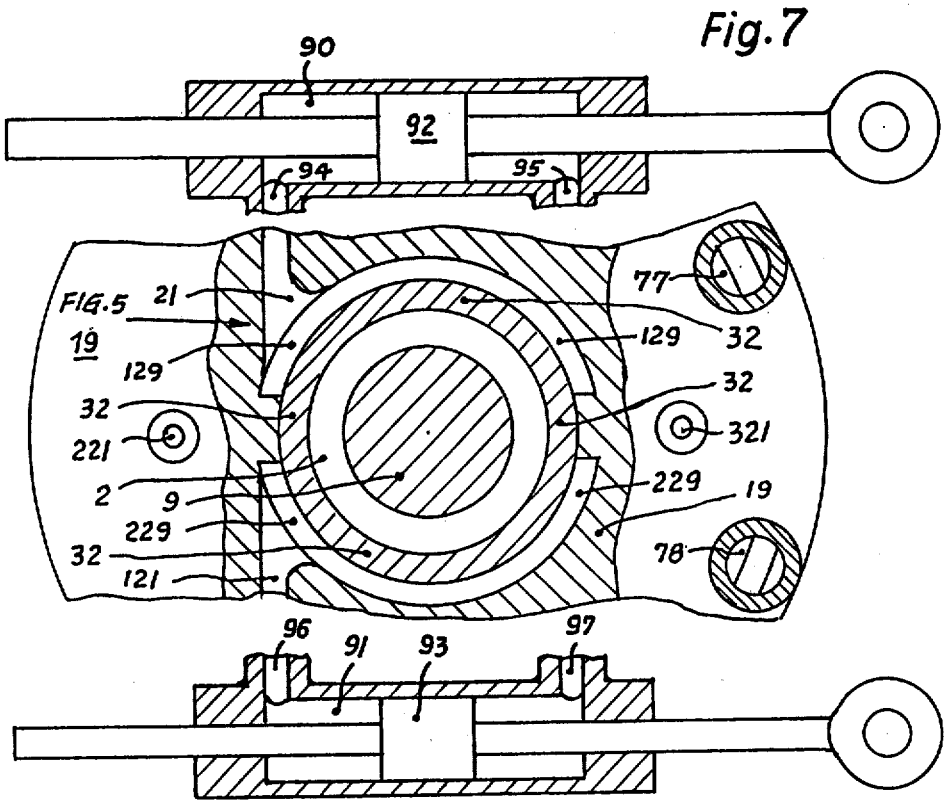
Fig. 7
90
92
94
95
FIG. 5
21
19
129
32
221
2
9
229
32
121
77
129
32
32
321
229
19
78
96
91
93
97

Fig. 12
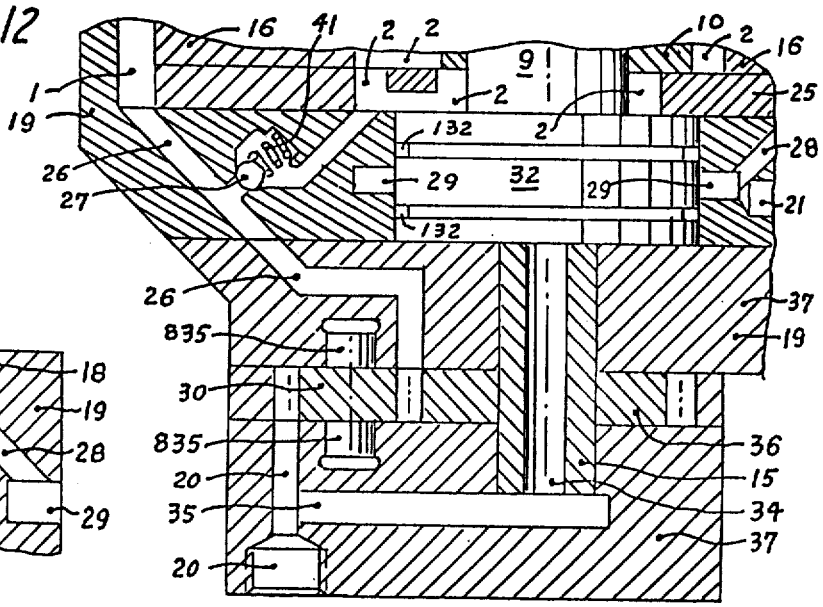
Fig. 13
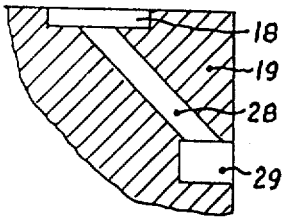
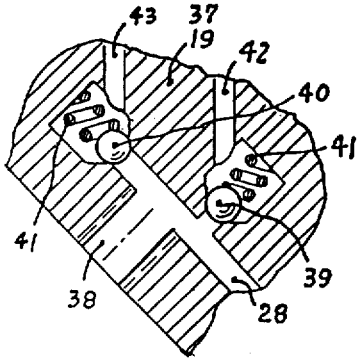
Fig. 14
Fig. 15
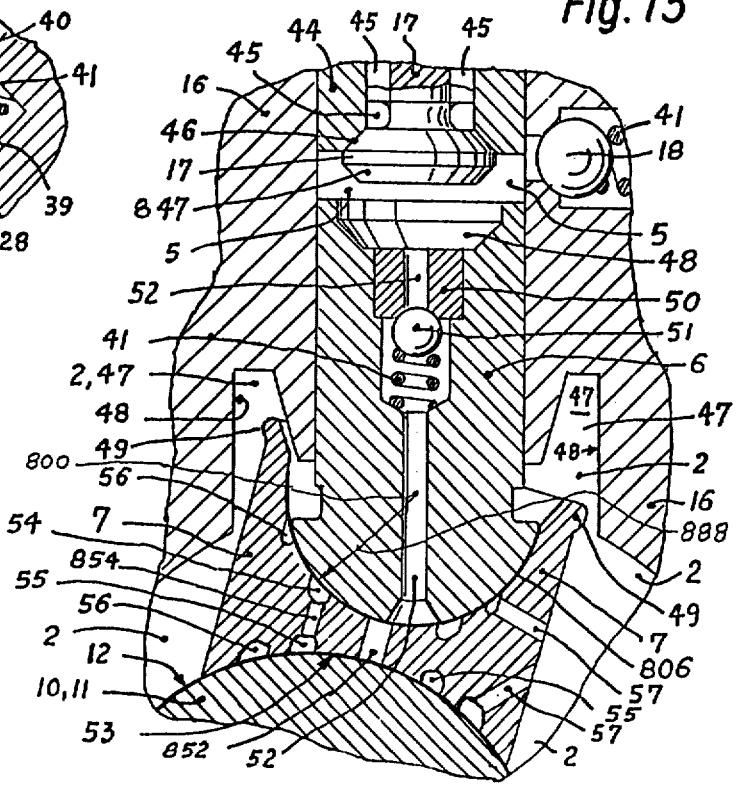

$$V_K = \left(-\omega e\left[\sin\alpha + \frac{e}{2R}\sin 2\alpha\right] + \Delta V_{imp}\right) R_K L_D d$$

HYDRAULIC ARRANGEMENT

BACKGROUND OF THE INVENTION

1. Field of the Invention

This invention relates to hydraulic arrangements as pumps, motors or transmissions and may even include some control devices. The invention uses a novel arrangement to obtain novel effects, like a pressure transmission, a very high pressure fourth pressure stage exceeding, if desired, ten thousand punds per square inch, automatic reciprocation, vibration, step advances or rotary steps of exterior linear or rotary hydraulic motors or others. Partially known elements of the former art or of of my earlier patents may be included in the novel arrangement if so desired or if of special value.

2. Description of the Prior Art

At this present time of filing this application there is no former art of the main aims of the invention known to the applicant. Also there are no arrangements known presently to the applicant which would correspond to the arrangement of the invention.

However, as applicant sees it, there are a great number of efficient hydraulic pumps, motors and transmissions available, which as pumps supply one or more flows of fluid, as motors are driven by a fluid flow from a hydraulic pump and as transmisisions combine a pump and motor in a single unit.

Some of them are my own elder patents and they are very effective and powerful. For example; my following elder patents: U.S. Pat. Nos. 2,975,716; 3,158,103; 3,223,046; 3,277,834; 3,398,698; 3,831,496; 3,850,201; 3,889,577; 3,960,060; 3,951,047; 4,212,230; 3,874,271 and others.

As far as motors or first pumps are used in the arrangement of the invention, these patents might be utilized in part in the invention or some of these patents may also be used entirely in a portion of the arrangement of the present invention. The last mentioned patent already uses the cam of the second space of this invention, however the piston shoes and piston of this elder patent fail to reach the high efficiency and pressure of this present invention. Moreover the mentioned patent partially failed because it did not take sufficient care of the required first and second spaces of the invention with the therein required first and second pressures.

3. Limitations of the Prior Art

The usual pump of the former art delivers a flow of fluid of permanent rate of flow. The control of the directional changes of pistons in external cylinders is commonly done by control valves. Plural flow pumps with equal rates of flow in different flows can do directional changes of external pistons, when they are equally variable, but the directional controls are then usually not very fast and not exactly volumetrically determined. Thus, they are not very good in vibrating or oscillating external pistons rapidly at high frequencies.

When hydraulic motors would drive highest pressure pumps to create a highest fourth pressure flow, they would require clutches between motor and pump and fastening housings to connect them. Their weight would exceed several times the weight of the arrangement of the invention, when present market pumps and motors would be used.

The pump of my U.S. Pat. No. 3,874,271 failed to set a disloading passage to the space, wherein the eccentric cam revolved or wherein the outer piston shoes moved.

That resulted therein, that after a short time of operation the leakages which escaped through the fitting clearance between the outer face of the piston and the inner face of the cylinder, the space wherein the cam or the piston shoes moved, filled up with a higher pressure and finally the pressure in this respective space became equal to the pressure of the pressure in the high-pressure cylinder or at least it exceeded the pressure which was supplied by the supercharger pump. The consequence thereof is, that the piston could not move any more under the pressure supplied from the first pump or from the supercharger pump. The piston just remained finally in a stationary position and the high pressure pump became unable to deliver any pressure fluid, because the piston did not, or only little, reciprocate.

The pump of U.S. Pat. No. 3,874,271 also failed to give enough long piston shoe stroke and piston stroke and also failed to operate at the sometimes required very high fourth pressure of the invention, because it had not long enough piston shoe extensions and not long enough or no recess-portions which extended beyond the outer end or innermost end of the cylinder deeper into the respective cylinder block. The piston shoes of this patent also failed to divide the balancing pockets into plural pockets with bearing lands or faces therebetween and thereby they failed to stand at very high pressures without increasing friction.

SUMMARY OF THE INVENTION

The invention attempts to either partially or totally to overcome or reduce the limitations and errors of the former art. In addition the invention aims to provide new hydraulic arrangements for novel operations or to do a novel work or novel works.

The invention also attempts to increase the powers and efficiencies of hydraulic arrangements.

The invention gives in a number of embodiments of the invention a number of solutions for the aims of the invention. These are described and illustrated in great detail in the decription of the preferred embodiments and in the figures of the drawings.

Some of the aims and objects as well as solutions of the invention, are as follows:

The basic and known provision of a hydraulic arrangement, the provision A, including in combination, a housing, a rotary shaft revolvably borne in said housing, at least one eccentric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring at least indirectly engages to guide at least partially the reciprocation-stroke of said at least one piston when said at least one piston reciprocates in said at least one cylinder. or;

The basic and known provision of a hydraulic arrangement, the embodiment B, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder wherein said first space is provided with a first pressure and said second space is communicated to a space of a second pressure and said second pressure is substantially lower than said first pressure. or;

With the known provision C with the arrangement of provision B, wherein a first pressure supply pump is mounted in said housing, driven by said shaft in unison with said cam and wherein a first pressure passage communicates from the outlet of said first pressure supply pump to said first space in said housing. or;

The known provision C, wherein an overflow relief valve is installed as a first pressure setting valve communicated to said first pressure passage to restrict the maximum of pressure of said first pressure and to lead the overflow of said first pressure setting valve into said second space of substantially lower pressure in said housing. And;

The arrangement of embodiment C, wherein said second space of said housing is provided with an unloading passage which connects and communicates to the entrance port of said first pressure supply pump and thereby to the intake line of said first pressure supply pump whereby said second space is communicated to a fluid line and a space of substantial low pressure. And;

A hydraulic arrangement, the embodiment D, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said first space is supplied with a first pressure and said second space is communicated to a space of a second pressure;

wherein said second pressure is substantially lower than said first establishing a difference of pressure between said first and second pressures;

wherein said first pressure presses through said at least one entrance port into said at least one cylinder and against one end of said at least one piston, wherein a passage extends longitudinally through said piston and said difference of pressure permits said piston to be pressed along the axes of said cylinder and of said piston regardless of the pressure in said passage towards said second space whereby said piston is pressed by said first pressure towards said outer face of said eccentric cam ring and at least into indirect engagement with said outer face of said cam ring. And;

The arrangement of embodiment E of embodiment D, wherein a piston shoe is interposed between the head of said piston and said outer face of said cam ring;

wherein a minimum inner pressure valve is mounted in said piston and communicated to a passage which extends through said piston from said cylinder to said piston shoe, wherein said inner pressure valve closes said passage through said piston at any pressure below the minimum setting pressure of said inner pressure valve but opens toward the piston shoe at any pressure exceeding said minimum inner pressure, wherein said piston shoe is provided with at least one fluid pressure pocket and at least one unloading recess, wherein said at least one fluid pressure pocket is communicated to said passage through said piston and to said inner pressure valve, wherein said unloading recess is communicated by a respective passage to said second space in said housing, wherein at least one of said fluid pressure pockets is closed radially by said outer face of said cam ring, wherein said piston forms a piston head outwards of said cylinder and directed towards said piston shoe, wherein said piston shoe forms a first slide face engaging said outer face of said cam ring and a second slide face which forms a bearing bed on the opposite end of said first slide face of said piston shoe, wherein said bearing bed and its second slide face are forming a part of a hollow ball of equal radii around a swing center;

wherein said piston head forms a head face of a configuration complementary to said second slide face and bearing bed with radii substantially equal to said radii and around said swing center, wherein said piston head engages said bearing bed and said piston and piston shoe are capable of pivoting around said swing center, wherein said first pressure presses said piston head against said bearing bed at closed position of said inner valve and maintains the engagement of said piston head and of said bearing bed, and, wherein said cam at an other portion of the rotation of said cam and of said shaft slides with its outer face along said first slide face of said piston shoe, presses over said piston shoe and piston head said piston inwards in said cylinder, whereby said inner valve opens and permits pressure from said cylinder into said pocket, whereby said piston supplies a flow of fluid of a fourth pressure through said exit port and said outlet out of said arrangement. And;

The arrangement of embodiment F with embodiment E, wherein said inner pressure setting is at least of so high a pressure, that the product of the cross-sectional area of said piston multiplied by said inner pressure setting supplies and exerts on the bottom of said piston in said cylinder a force which exceeds the friction of the outer face of said piston along the inner wall of said cylinder, the resistance of said piston and of said piston shoe to acceleration, the resistance of slide friction of said piston shoe along said outer face of said cam ring and the resistance of said piston shoe against acceleration and the lateral forces appearing from said bed and said head onto said shoe and onto said piston, whereby said piston remains at all times of its rest and of its reciprocation in said cylinder under said force with its head engaged in said bed of said piston shoe and said first slide face of said piston shoe on said outer face of said cam ring, wherein said cylinder bloch has a reception recess on its radially innermost portion for the partial reception of said piston shoe, said reception recess includes radial extensions laterally of said cylinder and extending radially outwardly beyond the radially innermost portion of said cylinder, wherein said cylinder block has radially inwardly extending guide portions, extending radially inwardly beyond said innermost portion of said cylinder and forming guide faces on said reception recess laterally of said cylinder, which extend radially inwardly and outwardly beyond said innermost portion of said cylinder, wherein said piston shoe has radially outwardly extending guide parts laterally of said bearing bed, of a dimension smaller than the distance between said guide faces of said reception recess, wherein at least said guide parts of said piston shoe are located at all times within said reception recess, while this arrangement together with end members axially of said recess prevent accidental escape of said shoe out of said reception recess but said engagement of said head and of said bearing bed is maintained by said first pressure and the said fourth pressure of said flow of fluid which is delivered by said piston, and, wherein said at least one fluid pressure pocket is so properly dimensioned that said shoe and piston are capable of pressures exceeding three thousand pounds per square inch at good efficiency without excess leakage and friction. And;

A hydraulic arrangement, the embodiment G, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one motor, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder.

wherein said housing includes at least one hydraulic motor, said inlet is communicated to the entrance means of said hydraulic motor, and, wherein said hydraulic motor is revolving said shaft and said eccentric cam ring when fluid is supplied to said motor. And;

A hydraulic arrangement, the embodiment H, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one motor, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder.

wherein said housing includes at least one hydraulic motor, said inlet is communicated to the entrance means of said hydraulic motor, and, wherein said hydraulic motor is revolving said shaft and said eccentric cam ring when fluid is supplied to said motor. And;

The embodiment I with embodiment H, wherein said hydraulic motor has a motor-exit fluid flow passage to a first pressure setting valve, which ends said motor exit passage and set to said first pressure, a first fluid flow passage extends from said motor-exit passage to said first space in said housing and a second fluid flow passage extends from the outlet of said first pressure setting valve to the motor outlet of said housing of said arrangement. And;

A hydraulic arrangement, the embodment J, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said housing includes at least one hydraulic motor, said inlet is communicated to the entrance means of said hydraulic motor, wherein said hydraulic motor is revolving said shaft and said eccentric cam ring when fluid is supplied to said motor, wherein said motor has an exit and said exit is provided with an overflow and pressure setting valve whereafter the outlet flow of said motor flows under the set pressure of said setting valve into said first space to flow through said entrance port and to drive said piston(s) outwardly in said cylinder(s), wherein said second space is communicated to a space under substantial low pressure which might be the outlet of said motor after said setting valve, and, wherein said motor drives over said eccentric cam said piston(s) to an inward stroke in said cylinder(s) to supply a flow of fluid of a fourth pressure out of said cylinder(s) and through said outlet out of said arrangement. And;

A hydraulic arrangement, the embodiment K, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein a pluality of said cylinder blocks and a plurality of said eccentric cam rings are provided in said housing axially behind each other respectively and along said axis of said shaft, wherein each of said cylinder blocks contains a plurality of said cylinders and each of said cylinder block groups is located radially of one of said eccentric cam rings respectively, while each of said eccentric axis of said respective eccentric cam ring is angularly displaced relative to the neighboring axis of the neighboring cam ring by an angle of threehundredsixty degrees divided by the number of said plurality of cam rings and cylinder blocks. And;

A hydraulic arrangement, the embodiment L, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein a plurality of said cylinders are connected over a respective plurality of exit ports to a common collection chamber, wherein said common collection chamber is communicated to a respective outlet;

wherein a plurality of said pistons in a plurality of said cylinders are combining their output flows to a common output flow in said collection chamber to be supplied out of said arrangement by a respective common outlet of said housing. And;

The embodiment M with embodiment L, wherein said housing contains a bore with an inner face of cylindrical configuration, said collection chamber is a radially extending recess extending through said inner face into said housing, and, wherein a closely fitting bush is inserted into said bore to seal along said inner face and thereby to close said radially extending recess and thereby said collection chamber radially inwardly. And;

A hydraulic arrangement, the embodiment N, including in combination, a housing, a rotary shaft revolvably borne in said housing, at least one eccentric cam ring revolving in unison with said shaft when said shaft revolves, surrounding a portion of said shaft and forming a cyclindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein at least one of said exit ports communicates through a respective passage to an individual outlet and any further communication of said individual outlet to any other exit port of said exit ports is prevented, whereby said at least one exit port of said at least one cylinder supplies the flow delivered by the respective piston of the respective cylinder as a separated and individual flow out of said individual outlet of said housing. And;

A hydraulic arrangement, the embodiment O, including in combination, a housing, a rotary shaft revolvably borne in said housing, at least one eccentric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said exit ports of said cylinders are open channels communicated to a respective outlet while one-way closing exit valves are prevented in said exit ports of said cylinders, whereby at one portion of the revolution the respective piston delivers a flow of fluid out of the respective cylinder, while at another portion of the same revolution the respective piston permits the entering of a flow through the respective exit port into the respective cylinder. And;

A hydraulic arrangement, the embodiment P, including in combination, a housing, a rotary shaft revolvably borne in said housing, at least one eccentric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said at least one piston, at least one cylinder and at least one exit port are pluralities of pistons, cylinders and exit ports equal in number relative to each other and individually one piston in one cylinder and one exit port on one cylinder in said plurality of pistons, cylinders and exit ports, wherein at least one of said pistons, cylinders and exit ports is connected over said exit port respective to at least one separated and individual outlet on said housing, while at least a plurality of the others of said pistons, cylinders and exit ports are communicating over the respective exit port to a common collection chamber and said common collection chamber is communicated to a common outlet to supply a common flow of fluid of said at least a plurality of the others of said pistons, cylinders and exit ports through said common outlet out of said housing. And;

A hydraulic arrangement, the embodiment Q, including in combination, a housing, a rotary shaft revolvably borne in said housing, at least one eccentric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said at least one piston, cylinder, entrance port and exit ports are pluralities of pistons, cylinders, entrance ports and exit ports, wherein said exit ports are passages without one way valves, wherein a first plurality of said exit ports is communicated to a first common collection chamber and a second plurality of exit ports is communicated to a second common collection chamber, wherein said first plurality of exit ports is provided to cylinders at one half of said housing and said second plurality of exit ports is provided on cylinders on the other, the radially opposite diametrical half, of said housing, wherein a common first outlet is communicated to said first common collection chamber, a second common outlet is communicated to said second common collection chamber, and, wherein an exterior cylinder is communicated with one of its ports to said first common outlet and with the other of its ports to said second common outlet, whereby the piston in said exterior cylinder is oscillated in said exterior cylinder, when said shaft and said eccentric cam of said arrangement revolve. And;

A hydraulic arrangement, the embodiment R, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said at least one entrance port, cylinder, piston and exit port are pluralities of entrance ports, cylinders, pistons and exit ports, wherein said housing includes at least two cylinder block groups of plural cylinders each and at least two of said cam rings, said cam rings and said cylinder block groups axially behind each other along said axis of said shaft, each one cylinder block group radially of one of said cams and said cams diametrically oppositely directed by diametric location of their eccentric axes relative to said axis of said shaft, wherein portions of said pluralities form separated communications to at least four separated outlets, and, wherein one of said outlets communicates through a fluid line to the first port of a first exterior cylinder and the second outlet of the same cylinder block communicates through a fluid line to the second port of the same first cylinder, while the first outlet of the second cylinder block communicates by a fluid line to the second port of a second exterior cylinder and the second outlet of the second cylinder block group communicates by a fluid line to the first port of said second exterior cylinder, whereby the first and second pistons in said first and second exterior cylinders are forced to oscillate at different directions at equal times in unison. And;

A hydraulic arrangement, the embodiment S, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said at least one cylinder, entrance port, piston and exit port are pluralities, wherein at least one of said exit ports includes an exit valve in said exit port and a passage to at least one single outlet on said housing and at least one fluid from said outlet to at least one exterior cylinder to drive an exterior piston in said exterior cylinder in timed and sized advances by periodic strokes, wherein at least a number of said exit ports are open passages without inserted one-way valves and communicating into a one collection chamber while at least another number of said exit ports are also open passages without inserted one-way valves but communicated to an other collection chamber, wherein said collection chambers have separated outlets communicated by fluid lines to different ports of at least one exterior cylinder, whereby at least one exterior piston is periodically advanced and at least one exterior piston is periodically reciprocated when said shaft and said cam of said arrangement revolve. And;

The arrangement of S, wherein said exterior pistons are the same piston in a single exterior cylinder, whereby said exterior piston is operated by said arrangement in a periodic oscillation with an overlaying automatic advancement. And;

The arrangement of S and above;

wherein said exterior piston in said exterior cylinder is utilized as thrust-vibrator or as an advancing reciprocator or advancing vibrator with automatic operation of oscillation, vibration, thrust and/or advancement and operated exclusively without additional controls by said arrangement and its provisions. And;

The arrangment of S embodiment T of embodiment S, wherein said arrangement which might include the provisions of claim 19 is utilized as an automatic press or hammering machine with automatic advance of a to be forged or to be pressed material and with angularly spaced pistons with formed piston heads on the pistons of said exterior pistons under substantial normal axes to said advance of said material, and, wherein said exterior pistons are at least partially so arranged, that when they press against said material at equal times their loads onto said material are balanced whereby said material remains at said pressing or forging without resultant components of radial load at least substantially, and, wherein said piston heads are moving at least pair-wise at equal times in pre-determined strokes and forces to form said material in a pre-determined and advancing automatic processing to a predetermined profile configuration. And;

The arrangement of embodiment R wherein at least one more piston which might be oppositely loaded by a spring, is communicated exteriorly of said housing to at least one of said fluid lines, whereby said one more piston might be utilized to lift or replace a member associated to said exterior piston in said exterior cylinder for automatically and periodically serving an additional, for example lateral, movement for example in a vehicle or machine which might also be a slotter or a shaving machine. And;

A hydraulic arrangement, the embodiment U, including in combination, a housing, a rotary shaft revolvably borne in said housing, at least on eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said housing contains revolvably borne therein at least one primary shaft and one secondary shaft of said at least one shaft, wherein said primary shaft is associated to an ingoing gear of a speed reduction gear and said secondary shaft is connected to the outgoing gear of said speed reduction gear while said secondary shaft carries and drives said eccenctric cam in said second space of said housing, wherein said at least one entrance port, cylinder, piston and exit port and pluralities and said exit ports are communicated to at least one exterior piston outside of said housing by at least one respective fluid line, whereby said reduction gear in said housing permits large sizes of said at least one cylinder and piston to assure a proper relationship of said plural pistons in said arrangement in said housing with said at least one exterior piston to operate said exterior piston with satisfying stroke and force.

A hydraulic arrangement, the embodiment V, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke at said at least one piston when said at least one piston reciprocates in said at least one cylinder, wherein said at least one entrance port, cylinder, piston and exit port are pluralities and said exit ports include one-way valves and are communicated to separated outlets of said at least one outlet respectively and separately, wherein at least one control valve is provided on said housing, wherein at least two of said separated outlets supply fluid of a fourth pressure through said control valve to a respective final outlet, wherein said control valve is subjected to an automatic control action when said fourth pressure exceeds the fourth pressure range while said control action closes at least one of said at least two separated outlets and communicates it to a space under substantial low pressure to continue the fluid flow supply of the remaining at least one separated outlet with a fifth pressure higher than said fourth pressure range into said final outlet, whereby in addition to a medial pressure first pump which may supply a first flow, said arrangement supplies stepwise variating high pressure flows with decreasing flow quantity at every increasing pressure in a higher pressure range, and, whereby said arrangement is enabled to supply from a power source of a given power extremely high pressures with reduced flow in relation to said given power of said arrangement. And;

A hydraulic arrangement, the embodiment W, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein at least one variable pump is driven by a primary power source and supplying a variable flow of fluid of a third pressure, wherein said variable hydraulic pump has an outlet which is connected to the inlet of said arrangement and thereby to the inlet of said motor in said housing, whereby said third pressure of said variable flow drives said motor in said housing with a variable and controllable rotary velocity, and, said fourth flow out of said outlet of said housing delivers its outlet flow with a rate of flow which is variable and defined in proportion to the rate of flow of said variable flow of said third pressure by said variable flow and said third pressure while said fourth flow has said fourth pressure and might be, if so desired, communicated to said control valve of embodiment V for reduction of rate of flow to said fifth pressure range of said embodiment V. And;

A hydraulic arrangement, the embodiment X, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring is at least indirectly engaging to guide at least partially the reciprocation-stroke of said at least one piston when said at least one piston reciprocates in said at least one cylinder, wherein said outlet is communicated by at least one fluid line to at least one exterior hydraulic fluid motor remote from said housing to drive said exterior motor in timed and controlled sizes of angular steps of rotation when said outlet delivers fluid. And;

The arrangement of the embodiment Y, with embodiment X, wherein said at least one inlet port, cylinder, piston, exit port and outlet are pluralities and some of said exit ports may be communicated to respective common collection chambers with respective outlets while one-way valves may be inserted or eliminated after said respective exit ports and before said respective outlets, wherein a plurality of rotary hydraulic fluid motors or oscillatable pistons in respective cylinders are communicated separately to said outlets to thereby drive a plurality of rotary or linear exterior hydraulic motors by said arrangement in timed relation with controlled rotary angular or linear steps in one or two linear or rotary directions or continuous linear or rotary motion.

There are still more objects and aims described in the invention. For example, one important aim is to prevent any non-responsivity of the respective piston in the respective cylinder by assuring the substantial low pressure in the second space, the higher pressure in the first space, which commonly is mentioned as the third pressure and the precise operation of the inner valve in the piston at a predetermined inner pressure in the piston's passage and in the cylinder. Because without these means a proper operation and a full responsivity is not at all times assured.

The invention includes as further aims also the improvement of the piston or more, of the piston shoe, in order to make it more effectively operable even at the highest pressures. For this purpose unloading recesses are definitely positioned in relation to the diameter of the piston and in relation to the fluid pressure balancing pockets or recesses of the piston shoe. Further, the fluid pressure pockets, associated to the piston shoe, are divided into plural recesses for building up bearing faces therebetween. A recess is cut out for the piston shoe-body in order to let the respective guide extensions on the ends of the mentioned recess enter into respective beyond-recess portions into the respective cylinder-block.

The inlet ports of the cylinders are provided in a preferred solution with specific springs to act in unison with the third pressure in the first space and guide faces are remaining on the inlet valves while fluid passages are cut into them when they are located and guided in respective inlet valve cases.

Other aims and objects of the invention are, for example novel machines or operations, like for example, vibration hammers, vibration of damp-truck shovels, vibration of transport bands, vibrations of conveyor belts, forgings and pressings or cuttings in unison while keeping the work piece stationary and moving the working pieces in unison towards the work-piece; provision of high pressure delivering pressure transmission to remote places by incorporating them into low or medial pressure fluid lines of a remote power source, cutting of concrete and iron or other materials by power shovels by the means of mounting pressure transmissions of the invention onto the working arms of power shovels, cranes and like, remote automatic control of working places in machine tools, agricultural machines, ships, vehicles, construction machineries and like for parallel actions or single actions, either stepwise, continually and linear or rotary depending on the respective desire and in accordance with the means and embodiments of this invention.

BRIEF DESCRIPTION OF THE DRAWING

FIG. 6 is partially a longitudinal sectional view through an other embodiment of the invention, and partially the housing of it seen from the outside.

FIG. 7 is partially a cross sectional view through still another embodiment of the invention, taken similarily to line V—V of FIG. 1 and partially seen from outside, wherein some sectional views of exterior cylinders are added.

FIG. 12 is a longitudinal sectional view through a portion of FIG. 1 in an enlarged scale and it incorporates some modifications of FIG. 1 and its embodiment.

FIG. 13 shows in a sectional view a portion of one of the embodiments of the invention.

FIG. 14 shows in an other cross-sectional view a modified portion of the invention.

FIG. 15 is a longitudinal sectional view through the cylinderblock portion, piston, piston shoe and entrance port and exit port of the invention in a larger scale.

DESCRIPTION OF THE PREFERRED EMBODIMENTS

In the Figures of the specification as far as differently pressurized spaces are essential referential numbers 1 indicate the first space; 2 the second space, 3 and, as far as provided the third space and 4 the fourth space. The referential numbers 5 indicate the cylinders, 6 the pistons, 7 the piston shoes, 9 the shaft; 10 the first eccentric cam ring, 11 the second eccentric cam ring, 12 the outer face of the respective eccentric cam ring, 13 and 14 the eccentric axes of the respective cam ring, 15 the axis of the shaft 9, 16 the cylinder block(s), 17 the entrance port, 18 the exit port, 19 the housing, 20 the inlet and 21 the outlet.

Figure 1:
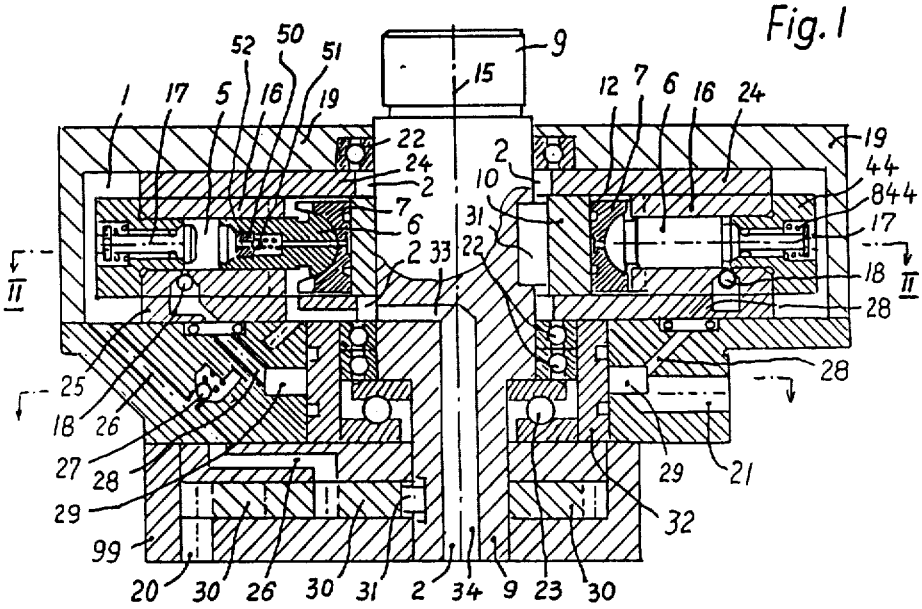
FIG. 1 is a longitudinal sectional view through one embodiment of the invention.
Figure 2:
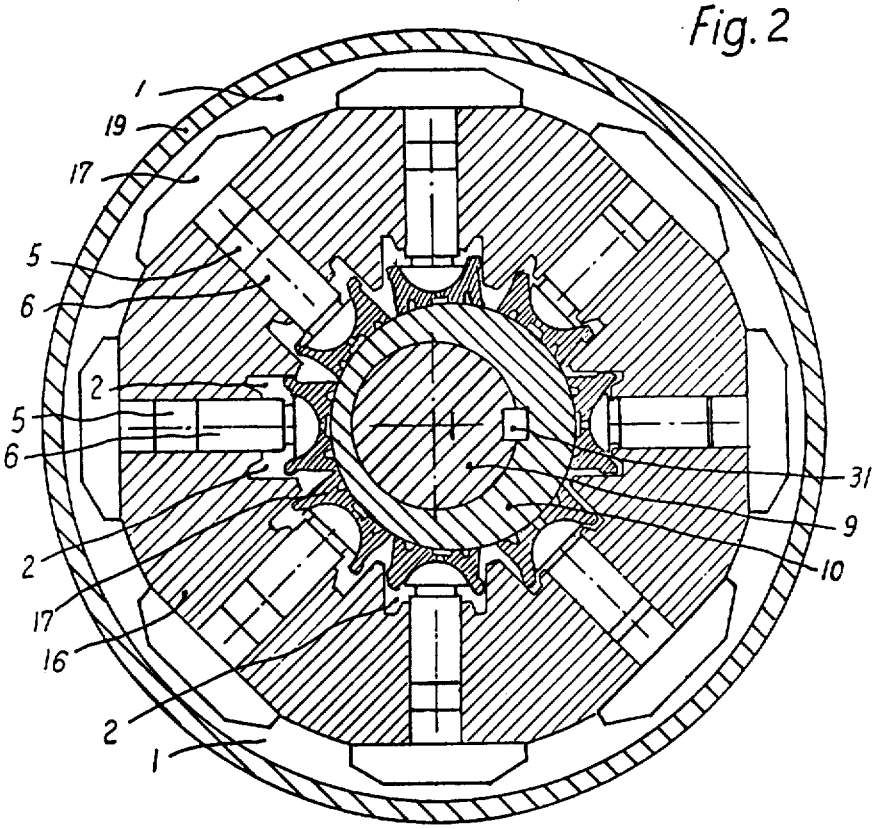
FIG. 2 is a cross-sectional view through FIG. 1 along the line II—II.

The embodiments work basically as follows:

An hydraulic arrangement includes in combination, a housing 19, a rotary shaft 9 revolvably borne in the housing 19, at least eccentric cam ring 10 and/or 11 revolving in unision with shaft 9 when the shaft 9 revolves, the mentioned cam ring 10,11 is surrounding a portion of the shaft 9 and is forming a cylindrical outer face 12 of equal radii around an axis 13,14 which is parallel to the axis 15 of shaft 9 but distanced therefrom by a first eccentricity or a second eccentricity; at least one cylinder 5 in at least one cylinder block 16 is provided in the mentioned housing 19 whereby the cylinder block 16 is containing at least one cylinder, at least one piston 6, at least partially connecting to at least one entrance port 17, and at least one exit port 18 to pass fluid into and out of the mentioned at least one cylinder 5 when the mentioned at least one piston 6 reciprocates in the at least one cylinder 5. The housing 19 has in its interior at least one first space 1 and at least one second space 2 and is provided with at least one inlet 20 and at least one outlet 21. The first space 20 is sealed and separated from the second space 2. The first space 1 engages the mentioned at least one entrance port 17 and the mentioned outlet 21 communicates to the at least one exit port 18. The mentioned second space 2 surrounds the at least one cam ring 10,11. The mentioned at least one piston 6 is capable of entering at least partially into the mentioned second space 2 and it is engaging at least indirectly the mentioned outer face 12 of the respective cam ring 10,11. The outer face 12 of the respective cam ring 10,11 is thereby at least indirectly engaging to guide at least partially the stroke or reciprocation of the mentioned at least one piston 6 when the shaft 9 revolves and the piston 6 reciprocates in cylinder 5. When the piston 6 is not directly engaging the outer face 12 of the cam ring 10 or 11, at least one piston shoe 7 is inserted between the piston 6 and the outer face 12 of cam ring 10 or 11. Referring now first to FIGS. 1 and 2, the housing 19 carries bearings 22 wherein the shaft 9 is revolvably borne. Thrust bearing 23 bears the end of shaft 9. The first space 1 is located around the cylinder blocks 16 and filled with fluid of a first pressure by first pump 30, which may also be driven by shaft 9. Inlet 20 leads the fluid to pump 30, which is drawn here as a gear pump but which might in this as well as in others of the Figures also be any suitable other pump, for example, internal gear pump, vane pump or fixed or variable piston pump. Key 31 connects the first gear 30 of the pump 30 to shaft 9. First pump 30 delivers the first pressure through passage 26 into the first space 1. The height of pressure in first space 1 may be set by relief valve or pressure limitation valve 27 which communicates with passage 26 and the second space 2, whereby excessive fluid supply from pump 30 flows over valve 27 into the low pressure- or second space 2. The eccentric cam ring 10 is fastened by key 31 to shaft 9. The outer face 12 of cam ring 9 has equal radii around the eccentric axis 10 which is radially displaced from axis 13 of shaft 9 but parallel thereto.

During operation of the hydraulic arrangement of these Figures and similarily in the other Figures, the pressure supplied by pump 30 and built up in the first space 1 as the first pressure, opens the entrance port 17 and presses the piston 6 in cylinder 5 downwards into its bed in the piston shoe 7 and the piston shoe 7 thereby against the outer face 12 of cam ring 9. When the outer face 12 moves away from the cylinder block 16 at one half of the revolution, the cylinder 5 fills up with fluid over inlet port 17. In FIG. 1 inlet port 17 is an inlet valve. At the other half of the revolution the outer face 12 of eccentric cam 10 moves toward the cylinder block 16. Piston shoe 7 then presses the piston 6 into the respective cylinder 5. The FIGS. 1 and 2 show a plurality of cylinders 5 and pistons 6 in cylinder block 16 and an equal number of piston shoes 7 interposed between the outer face 12 and the respective piston 6. At the inwards stroke of the respective piston 6 the entrance port 17 closes and exit port, in this case exit valve, 18, opens. The fluid is pressed out of the respective cylinder 5 by the respective piston 6 over the exit port 18 and enters into the passage 28 wherethrough it flows into the common collection chamber 29. Each exit valve 18 has a connection to a respective passage 28 and each passage 28 in this Figure ends into the common collection chamber 29. From the common collection chamber 29 the fluid is passed through the outlet 21 out of the arrangement in housing 19.

It is very important, that the first pressure in the first space 1 is high enough to open the inlet ports 17 and high enough to press the pistons 6 downward in the inlet stroke and it is still more important, that the first space 1 is sealed and separated from the second space 2. The second space 2 must be empty of pressure or contain a second pressure which must be substantially lower than the mentioned first pressure. Because if there is too high a pressure in the second space 2 which surrounds the cam ring, 10, piston end of piston 6 and the piston shoe 7, the pistons 6 would not move towards the outer face 12 of the cam ring and the device could then not work. The second space 2 is therefore connected by passage 33 over passage 34 to the outside or to a space under substantially low pressure. In FIG. 12 it is shown, that passage 34 of second space 2 may become connected by passage 35 to the inlet 20 of pump 30, which contains suction pressure or other low pressure.

To make the manufacturing of the collection chamber 29 possible, a bush 32 is inserted into housing 19 and it may carry the bearing 22. Bush 32 closes the collection chamber 29 radially inwards. Outlet 21 is communicated to the common collection chamber 29.

In one series of these arrangements which were just completed a few weeks ago, the first pressure was about eight atmospheres, the housing 19 was an aluminium alloy casting, the second pressure was about one atmosphere and the fourth pressure, which is the high pressure supplied out of outlet 21 reached peak pressures of 12000 twelve thousand psi. The overall efficiency was extremely good and the reasons for the good efficiency will become explained at hand of FIG. 15 which shows the preferred embodiments of entrance port, exit port, piston, cylinder block and piston shoe as well as the cylinder in a greater scale for better visibility in the drawing.

Member 24 in FIG. 1 may be provided, when the cylinder block 16 consists of a plurality of individual blocks and plate 25 may serve also in the same way as member or plate 24 to hold separated blocks 16 radially together by common pins in common seats. But plate 25 may in addition facilitate the provision of spring seats for the exit ports or exit valves 18 and it may also serve to make the machining of passages 28 and the connection portions of passages 28 easier.

A part of the bottom portion of FIG. 1 is demonstrated in a larger scale in FIGS. 12 to 14. The interior of piston 6, like referentials 50 to 52, is explained at the description of the enlargement FIG. 15.

FIG. 2 is the section through FIG. 1 along line II—II and shows the location of the plurality of cylinders, pistons and piston shoes respectively and in respect to the cam ring 10. The configuration of the section through cam ring 10 is also shown in FIG. 2.

In FIG. 12 the common collection groove 29 is clearly seen and shown is also how it is closed by the insertion of bush 32, which is here demonstrated as seen from the outside. It should be noted, that seal beds 132 are provided between housing 19 and bush 32 to seal the common collection chamber 29 from axially directed losses of fluid. Housing portion 19 is in this area of location radially widely extended in order to provide the required strength to prevent radial deformation under extremely high pressures of up to about ten thousand pounds per square inch in the collection ring groove chamber 29. This Figure also shows more clearly visible a portion of the second space 2 and of the first space 1. The connection of inlet 20 to pump 30 is demonstrated, one of the gears 30 has a shaft 835 to bear the gear in the housing 37, the location of passage 26 is visibly shown and also the connection of it from the outlet of the first pump or gear pump 30 to the interior of housing 19 into the first space 1 therein. The valve 27 is also more clearly visible in this Figure than in FIG. 1.

FIG. 13 shows the location of passage 28 of one of the exit ports to the common collection chamber 29 through a respective portion of housing 19. Seal beds 18 may be provided to set seals between the cylinder block(s) 16 and the respective member 25 and-or housing portion 19.

FIG. 14 explains, that, when so desired, passage 28 may receive a connection port 39 to facilitate the possibility to lead a portion of the fluid supplied by pump 30 to other places than the first space 1. Valve 39 may replace valve 27 of FIG. 1, passage 42 may serve to lead the overflow of valve 39 into the second space 2. Valve 40 may be provided to passage 28 and may serve to set a minimum pressure in passage 28 which would then be the fourth pressure. Behind valve 40 the passage 43 leads the overflow through valve 40 into the first space 1 of the arrangement. The purpose of FIG. 14, which might be incorporated in FIG. 1 or other Figures of this specification thereby becomes, that a fourth pressure can be supplied by pump 30 to a desired connection or location, while the fourth pressure in passage 28 is subjected to a minimum of pressure by valve 40 and to a maximum of pressure by valve 39, while at the same time the supply of fluid under the first pressure into the first space 1 is maintained and the overflow over valve 39 is also assured to pass into the second space 2.

FIG. 15 shows the preferred actual design of the cylinder block 16, cylinder 5, piston 6, piston shoe 7 inlet port 17 and outlet port 18, in a larger scale and with more details than in the other Figures. The entrance—and exit—ports are valves in this Figure. Entrance valve 17 is axially reciprocably borne in entrance valve case 44. Valve 17 may be slightly spring-loaded on its outer end for moving it upwards in FIG. 5. Valve 17 also has passages 45 to pass fluid through it and it has a seat face 46. The seat face 46 bears and seals on seat bed 46 in valve case 44. The front end of valve 17 may have a strengthening portion 847 and may have a medial valve head 17 between 46 and 847.

Portions 17, between 46 and 47 and portion 47 are serving to make the valve 17 rigid and undeformable and thereby able to withstand without deformation the high pressure in cylinder 5. Valve case 44 should be made equally strong and may be fastened to cylinder block 16 by respective bolts. The exit valve 18—in the drawing a ball—is very closely located to the cylinder 5. The passage from the cylinder 5 to the seat of valve 18 is extremely short, to prevent dead space. Valve 18 may be loaded by spring 41. The passage between cylinder 5 and valve seat 18 may just be long enough to provide the required strength to the seat of valve 18. The outer face of ball-type valve 18 may thereby almost reach the cylinder 5 partially. The said passage before valve 19 may end partially into the cylinder 5 and partially against valve case 44 to be effective at all positions of the piston stroke.

It is desired in this arrangement to obtain extremely high efficiency in this pumping stage. That is obtained thereby, that the dead space in cylinder 5 is reduced to the unavoidable minimum of volume. To achieve this, the outer piston end of piston 6 is provided with a recess 48 of a configuration complementary to portions 47 and or 47 and 17 between 47 and 46. Thereby portions 17–47 of valve 17 can enter into recess 48 and practically completely fill space 48 in piston 6 when piston 6 is in its innermost position or in the inner dead point of reciprocation in the cylinder 5. The outer end of piston 5 then practically touches the end of valve case 44 and the dead space in the arrangement is thereby limited to the volume of the passage between cylinder 5 and the valve seat of valve 18. The fluid from cylinder 5 can entirely and completely become delivered except the small volume of the passage between cylinder 5 and the seat of valve 18. Internal compression losses in fluid are by this arrangement reduced to a minimum.

Passage 52 extends through piston 6 to lead lubrication—and pressure balancing—fluid therethrough into the balancing pockets 54,55 of piston shoe 7. A valve 51 is spring loaded by spring 41 and contained in passage 52 in piston 6. It seats on insert 50. The load of spring 41 is strong enough to assure to remain closed as long as the piston is pressed downward in the inlet stroke. Closing force 41 must be strong enough to over-rule the forces of friction of the outer face of the position in the cylinder and to over-rule the acceleration resistances of the piston against movement. 2 to 30 atmospheres pressure are usual as opening pressure for valve 51. At the delivery stroke, when the piston 6 moves upwards in cylinder 5, valve 51 opens. High pressure fluid is then in the hydrostatic balancing pockets 54 and 54. Their location and size is exactly dimensioned to obtain the highest efficiency by small friction and leakage along the outer face 12 of cam ring 10,11 and between the piston head and the piston shoe 7.

Unloading recesses, for example 56, are surrounding the hydrostatic bearings which include the fluid pressure pockets 54 and 55. Pockets 54 and 55 may become divided into pluralities of pocket portions to lubricate bearing faces therebetween. The unloading recesses 56 etc. are communicated for example by passages 57 to the second space 2. The upper face and bottom face of piston shoe 7 correspond complementary to the respective end face of piston 6 and outer face 12 of cam 10,12.

Cylinder block 16 has recesses 47 with guide walls 48 to permit the piston shoe to enter into them. Guide extensions 49 are provided on the piston shoes to be guided along faces or walls 48 of recess 47. Portions 49 remain at all times within recess 47. Recess 47 extends radially outwardly beyond the innermost portion of the cylinder 5 in block 16. The portions 49 of the piston shoe 7 pass temporarily during the piston stroke beyond the inner end of the cylinder 5 deeply into the recess 47. The piston and shoe center themselves under the forces exerted onto them. They are not mechanically connected. The provision of recess 47 and of extensions or portions 49 prevent any escape of the piston shoe 7 out of the recess 47. A long piston stroke is thereby obtained and the proper alignment of piston 6 and shoe 7 is at all times enforced and secured.

The application of the pockets and recesses 54 to 56 requires skill and experience as well as knowhow to obtain the optimum of result. For details the inventor, whose address is visible in the application, may be contacted. The radius of the piston head, which enters into the complementary formed seat in piston shoe 7 depends on the pressure desired and is also a matter of knowledge and experience. The inner diameters of the unloading recesses should only very slightly exceed the diameter of the respective piston 6.

Figure 3:
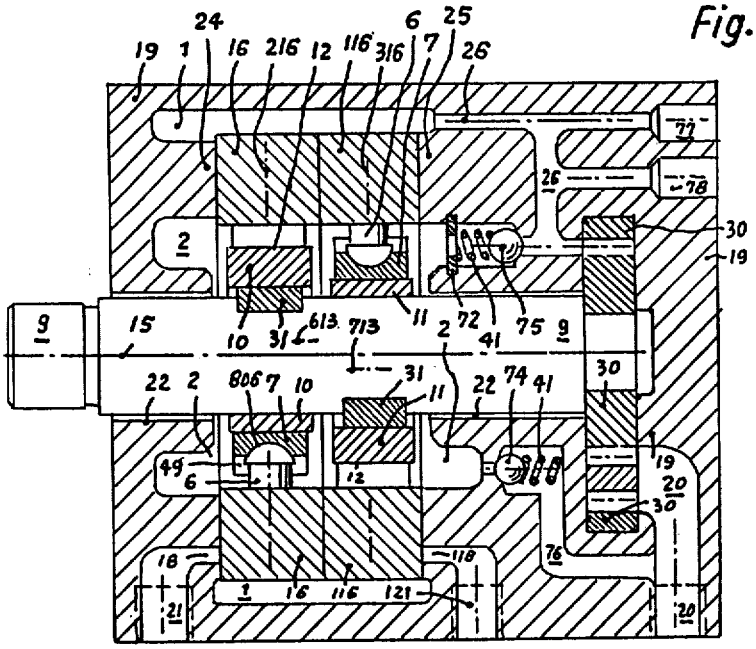
FIG. 3 is a longitudinal sectional view through another embodiment of the invention.

In FIG. 3 the next embodiment of the invention is demonstrated in a longitudinal sectional view. It differs from FIG. 1 mainly therein, that not a single eccentric cam ring 10 is provided, but a plurality of eccentric cam rings 10 and 11. Each of the cam rings is associated to a respective cylinder block set 16 or 116. In FIG. 3 the plurality of cylinder blocks 6, 16, 116 is located axially one after the other. The cam rings 10 and 11 are also axially behind each other located. In this embodiment the plurality consists of cylinder blocks 16, 116 with plural individual cylinders each, as in FIGS. 1,2. The number of eccentric cam rings 10,11 should be equal to the number of cylinder block center faces 216,316 and the center faces 216,316 should substantially be equal to the respective medial radial faces of the cam rings 10,11. The plural cam rings 10,11 may have different eccentric axes or equal eccentric axes. In the Figure, which has two blocks 16,11 and 2 cams 10 and 11, the cam 11 is 180 degrees turned angularily relative to cam ring 10. The respective keys 31 show their fastening against rotation on shaft 9. In the Figure cam ring 10 shows the wider portion to the top of FIG. 3 and around eccentric axis 613, while cam ring 11 shows its bigger portion downward and around the eccentric axis 713, whereby the eccentric axes 613 and 713 are located diametrically oppositely respective to the axis 15 of shaft 9. In the case of application of three cam rings they may be turned 120 degrees relative to each other, in case of application of five rings they may be turned 72 degrees relative to each other and so on.

The feature of the arrangement of FIG. 3 is specifically, that plural flows are supplied from the device when so desired and that single flows can be set to act at equal times with equal volumes. This will be explained more detail in connection with some of the later Figures.

Otherwise also this Figure has a first pump 30, in this case an internal gear pump, which suctions fluid through inlet 20 and delivers it into the first space 1 through passage 26. A first space pressure limitation—or overflow—valve 75 may be set between passage 26 and the second space 2 and be loaded by spring 41 which may be held by retainer 72. The second space 2 may in this or in other Figures also obtain a low-pressure setting valve 74 with loading spring 41 to overflow into inlet 20 through passage 76. The feature of this valve is to keep a certain fluid under relatively low pressure and in any case under substantially lower pressure than the first pressure in the first space 1 is inside of space 2 in order to maintain a lubrication of all faces in the second space 2.

FIG. 3 also shows, that outlets 77 and/or 78 may be extended from passage 26 through housing 19 in order to permit the exit of fluid of the first pressure out of the arrangement to do work on places external of the housing 19 of the arrangement, when the first pump 30 is sufficiently dimensioned to supply enough first pressure fluid. The members 24 and 25 of FIG. 1 are in this present FIG. 3 integral portions of housing 19 and keep the cylinder blocks 16 and 116 closely fitted between portions 24 and 25. When so desired, a medial plate might become inserted between blocks 16 and 116, but such plate is not drawn in FIG. 3. But it is demonstrated as plate 80 in FIG. 6.

All pistons 6 of both cylinder blocs 16, 116 or of the plurality of cylinder blocks may deliver the respective fluid into a common collection chamber 29 as in FIG. 1. But that is not demonstrated in FIG. 3. In FIG. 3 it is however demonstrated, that each cylinder block may deliver into a common collection chamber 18 of the respective cylinder block. But there is still another possibility demonstrated in FIG. 3, namely that each individual piston 6 may deliver into an individual outlet 21, 121 over the respective exit port 18.

While FIG. 1 had exit valves 8 as exit ports, the exit ports 18 in the bottom of FIG. 3 have no exit valves but only simple exit ports which end directly into the respective outlets 21 or 121. It is important however, to note, that these ports 18 are not a must, but that instead the outlet valves 18 of FIG. 1 could be provided in FIG. 3 or 6 if so desired. The piston shoes 7 are shown in simplified sectional views without balancing and unloading recesses in this Figure and the portions of the pistons 6 which extend from the blocks 16,116 into the second space 2 are shown in outside views in this Figure.

Figure 4:
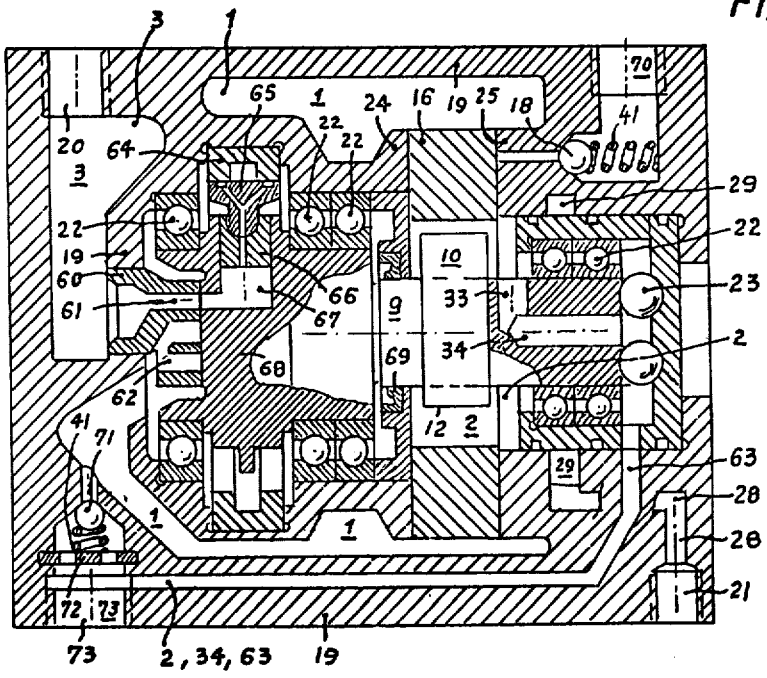
FIG. 4 is a longitudinal sectional view through a further embodiment of the invention.

FIG. 4 will be described later, because FIGS. 6 and 7 to 9 are applicable if so desired in or to FIG. 3. These Figures are therefore discussed now immediately hereafter.

Figure 8:
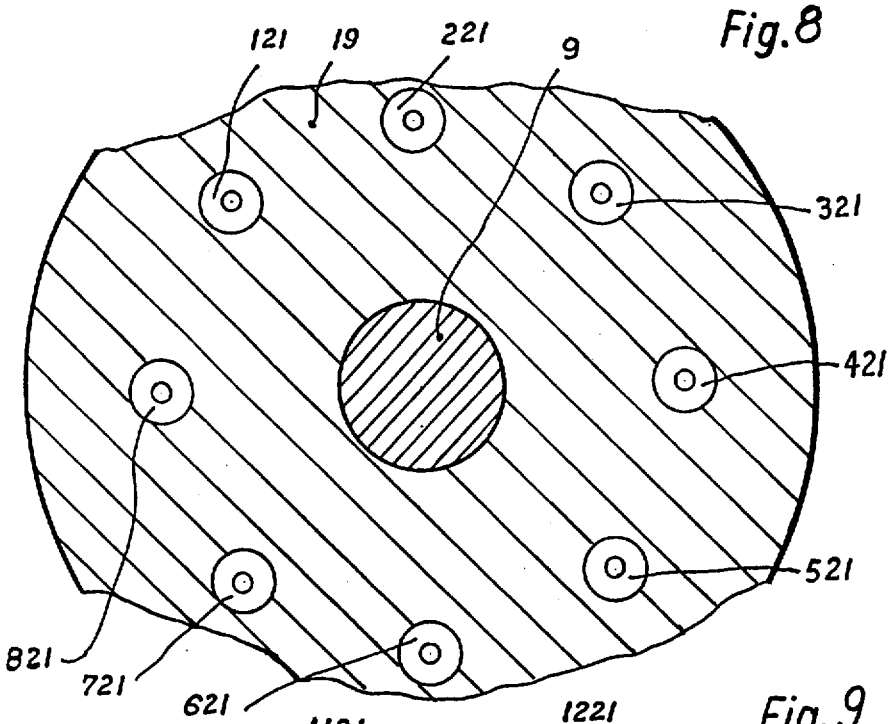
FIG. 8 is a cross-sectional view through FIG. 6 along the line VIII—VIII.
Figure 9:
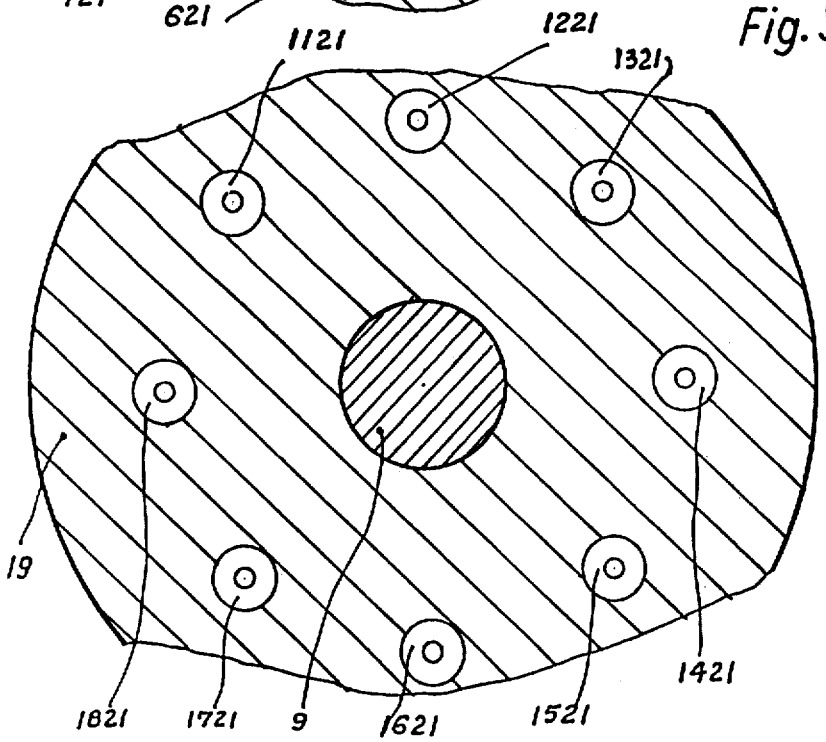
FIG. 9 is a cross-sectional view through FIG. 6 along the line IX—IX.

FIGS. 8 and 9 demonstrate in their sectional views through FIG. 4 or 6, that each cylinder 5 may have an individual outlet. For example outlets 121, 221, 321, 421, 521, 621, 721 and 821 from cylinder block 16 of FIG. 4 or of FIG. 6 and outlets 1121, 1221, 1321, 1421, 1521, 1621, 1721 and 1821 from cylinder block 116 of FIG. 4 or of FIG. 6. Shafts 1 and housings 19 are shown to complete the FIGS. 8 to 9.

FIG. 6 also shows partially the interior of an arrangement with a plurality of cylinder blocks 16,116 and the associated means, as partially known from FIG. 3. The innermost plate 80 is assembled in this Figure between the cylinder blocks 16 and 116 whereby it can serve together with plates 24 and 25 to hold individual cylinder block of the respective cylinder block group 16 or 116 in radial location by pins in respective bores through parts 16,116,24,80,25. That makes it easier to machine the recesses 47 in respective single cylinder blocks 16,116. Seals or fits must then be provided between respective individual cylinder blocks in order to maintain the required separation and sealing of the second space 2 from the first space 1. Seals and/or bearings may be inserted in chamber 79 of housing 19 around shaft 9. The first pump 30 may be located in housing portion 99.

The speciality visible in FIG. 6 is further, that the cylinders 5 are openly connected to the exit ports 18,218,118,318 etc. respectively and the ports 18,118,218,318 etc are ending into the individual outlets 121,221,321,421 etc. respectively.

With this arrangement the device can become an actuator for example for multiple vibrations or oscillations. For example, each one separate fluid line may be set to each one separated spring loaded piston in respective cylinders exterior of housing 19. When the arrangement contained in housing 19 operates by revolving shaft 9, each exterior individual piston will then be subjected to periodic pressure fluid supply and pressure fluid return into cylinders 6. Each respective exterior piston can thereby become oscillated or vibrated in the desired frequency by the respective rotary angular velocity of shaft 9 of the device. And, in addition the timing of the oscillations or vibrations of the exterior pistons or cylinders can be controlled and be set into a definite relationship relative to each other by the respective fluid line connection to the respective outlet with end digits 21. The arrangement can become multiplied or reduced by the application of the respective number of cylinder blocks or cylinder block groups 16,116,216, 316 and so on.

FIG. 7 demonstrates in a cross-sectional view either through pump arrangement of FIG. 1, 3, 6 or 4, that the common collection chamber 29 can also become divided into separated collection chambers 129 and 229. In addition separated outlets 221 or 321 may be provided to others of the cylinders 5 of the arrangement. For example a plurality of cylinders 6 may be connected over the respective exit ports or exit valves 18 to the first collection chamber 129 and another plurality of cylinders 5 may be connected via the respective exit ports or exit valves 18 to the second collection chamber 229. A single one or a third plurality of cylinders 5 may be connected respectively to outlet 221 and others to outlet 321.

Collection chamber 129 may have the outlet 21 and collection chamber 229 may have the outlet 121.

This possibility of arrangement can supply a number of novel actions to the exterior of the housing 19. For example, outlet 21 connected to inlet 94 of outer cylinder 90 and first pressure outlet 77 connected to inlet 95 of cylinder 90 may periodically and with the frequency of rotational speed of shaft 9 oscillate the piston 92 in cylinder 19. Connection of outlet 121 to inlet 96 of exterior cylinder 91 and connection of first pressure outlet 78 to port 97 of cylinder 91 may reciprocate piston 93 in exterior cylinder 91 in a stroke and frequency defined by the number of interior pistons 6 connected to collection chambers 129, or 229 respectively and by the rotary speed of shaft 9.

The connection could also be otherwise. For example collection chamber 129 might be connected to one of the ports of one of the exterior cylinders 90 or 91 and collection chamber 229 to the other port of the same exterior cylinder.

Still another possibility would be to add outlets 221 or 321 or both to one or more of the ports 94,97 or others of the exterior cylinders 90,91 or to other exterior cylinders. When connected to for example exterior ports 90 and 91 and, when exit valves 18 are set into the exit ports of outlets 221 or 321 respectively, the cylinders pistons 92 and 93 would become subjected to a plurality of actions. Namely to oscillations or vibrations by chambers 129,229 respectively and to an additional periodic axial forward movement by stepwise supply of fluid into one of the spaces in the exterior cylinders 90 or 91. Thus, there would be a vibration plus a periodic volumetrically exactly defined forward movement overlaying the oscillating action on pistons 92 and, or 93.

The embodiment of the invention contained in the arrangement of FIG. 4 is commonly utilized as a pressure transmission. Several machines or vehicles, for example ships, aircraft, power shovels, trucks and the like commonly have a basic pressure source or pump of medial or limited higher pressure, for example 3000 to 5000 psi. But at locations remote from the basic pressure source there are occasionally very high pressures desired, for example 5000 to 15,000 psi. It is then very economical in investment and practical in application to set the pressure transmission of FIG. 4 at the place close to the required high-pressure operation.

Inlet 20 of FIG. 4 is then communicated to the fluid line which carries the basic pressure from the commonly available basic fluid pressure source in the vehicle or machine. The said basic pressure fluid enters the third space 3 in housing 19 as the third pressure. From space 3 the third pressure fluid flows through control body 60 and through control port 61 into the respective cylinders 67 of hydraulic motor 68. Thereby the pistons 66 are moved outward in the cylinders 67 and are running with associated piston shoes along the piston stroke guide 64. Thereby the motor 68 is revolved and supplies the rotary motion and power to shaft 9 to revolve shaft 9 and to drive the cam ring(s) 10,(11) around. When the third pressure fluid flow has set the fluid motor 68 into rotation and maintain the respective time of rotation, the fluid leaves the respective expelling cylinders 67 through the exit passage 62 of control body 60 and flows then into the first space 1.

First space 1 is separated from second space 2 by the seal 69 in housing inner portion 24. And the third space 3 is sealed from the first space 1 by the control body 60 in the respective housing portion of housing 19. The fourth pressure space is the common collection chamber 29 and a fifth space may be one or more single outlets 70. The first space 1 contains the first pressure, which is the outlet pressure of the motor 68, the second space is the low pressure space 2 and contains the second pressure 2 of substantially lower pressure than the first pressure in the first space 1. The first space 1 may have a pressure limitation or overflow valve 71 loaded by spring 41 and held by retainer 72 to let the overflow escape into the second pressure space 2 and its outlet 73.

The rotor 68 of motor 68 may be borne in radial bearings 22 and so may be the shaft 9 which is integral or common to motor 68 and eccentric cam 10. The axial load may be carried by thrustbearing 23. Similar radial bearings 22 may be assembled in the bush 32 which is alread known from FIG. 1. For obtaining a good efficiency, high power at the cost of little wight, it is recommended to use as motor 68 and as control body 60 one or the other of my known U.S. Pat. Nos. 2,975,716; 3,158,103; 3,223,046; 3,277,834; 3,398,698; 3,831,496; 3,850,201; 3,889,577; 3,960,060; 3,951,047; 4,212,230 or others. Cylinder block 16 is contained between housing portions 24 and 25 as known from the already discussed Figures and it contains at least partially the cylinders 5, the pistons 6, the entrance ports 17, the exit ports 18 and the piston shoes 7 are interposed between the respective pistons 6 and the outer face 12 of eccentric cam 10 as also known from the other Figure and as not shown in FIG. 4, because it is already explained at hand of the earlier discussed Figures. The second space with its substantial lower second pressure communicates through passages 33,34,36 with low pressure outlet 73 which may connect to the entrance passage of the basic power source or to the fluid tank of the machine or vehicle.

The highest pressure or fourth pressure is the pressure in the fourth space which is the common collection chamber 29 which is known from the discussion of the earlier discussed Figure. It is in this embodiment connected to a plurality of single exit valves 18 of respective cylinders 6. It supplies the fourth or highest pressure of for example 4000 to 15,000 psi out of outlet 21 via passage 28 as already known from the earlier Figures. If so desired, the outlet pressure may however also be less than 4000 psi. If so desired one or more separated outlets 70 may be provided to single or combined other exit ports or exit valves of other cylinders 5. They may exit a fifth pressure out of the fifth space 70 through outlet 70. An exit valve 18 with spring 41 may be respectively provided in the respective exit passage and outlet 70 or therebetween. The pressure flows supplied out of outlet 21 or out of outlet 70 are effectively capable for highest pressure work at the desired remote place in the vehicle or machine without installation of any other or highest pressure pump or source beside of the device of FIG. 4.

Figure 5:
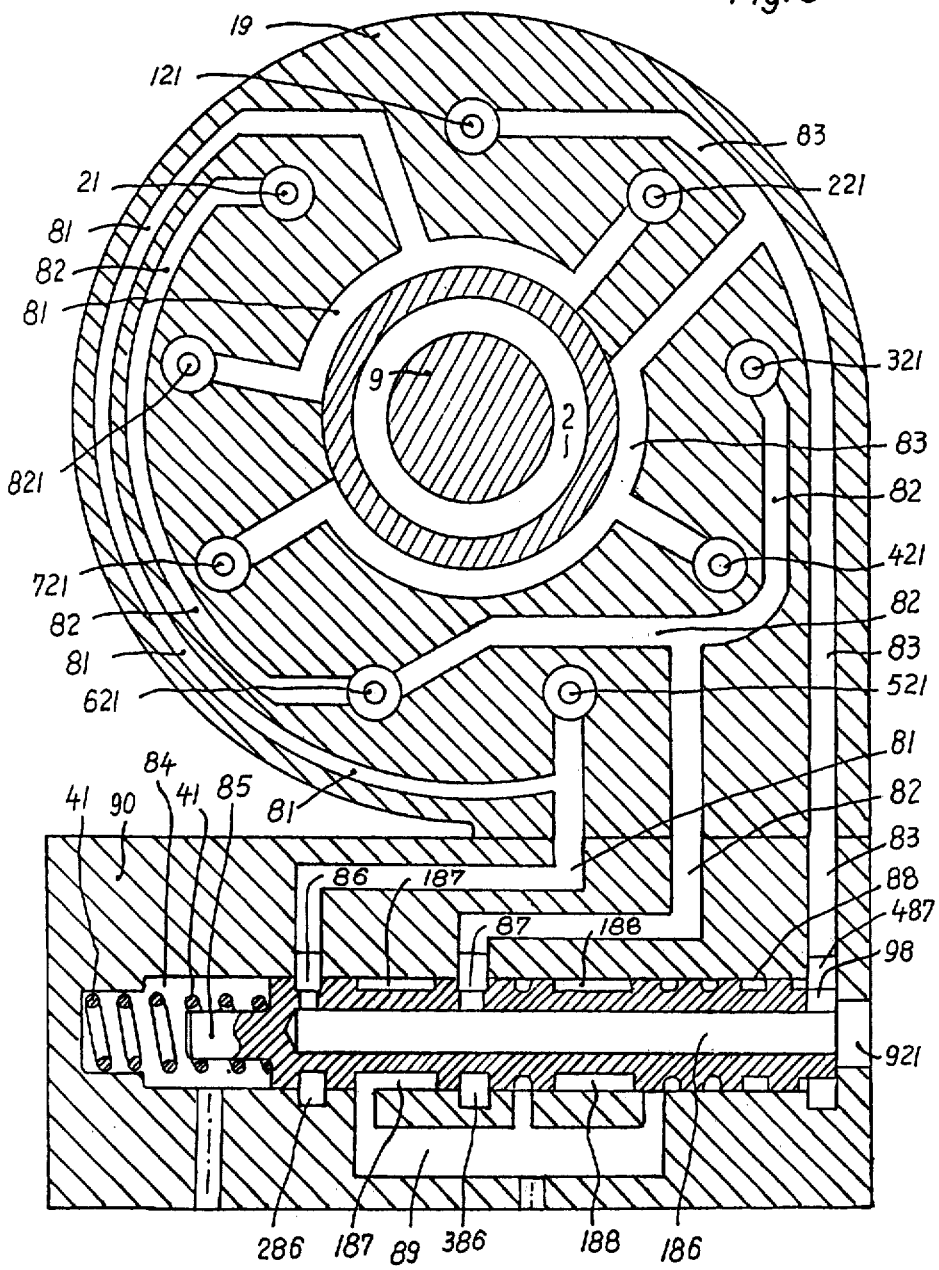
FIG. 5 is a cross-sectional view through still a further embodiment of the invention.

The arrangement of FIG. 5 contains a stepwise variable highest pressure pump. A housing 19 may contain the first pump 30 as in some of the other figures. But instead of applying a medial pressure gear pump or the like, it is in this embodiment also recommended to use as the first pump in housing 19 one of my variable radial piston pumps, for example of the patents which were mentioned at the description of FIG. 4. Since this pump 30 then can be variable, there is a first pressure range of roughly 1 to 3000 or 5000 psi which is entirely steplessly variable. The variability is often desired, when the primary power source has only a limited capacity. The lower pressure flows shall then be of larger quantity in order to be able to operate a working place with low force but with high speed. The higher pressure stage must then be of lower flow quantity, because otherwise the power source would fail because it has not enough power to operate the bigger pressure range with the big flow rate quantity of the medial pressure range. Since it is not easy and not simple to use the arrangements of the former Figures for a stepless variable operation at the higher pressure ranges, the embodiment of FIG. 5 supplies a partially and stepwise variability of the flow quantity of the highest pressure ranges.

The figure uses in its embodiment the stepwise connecting and disconnecting of outlets in order to decrease the flow quantity stepwise with ever increasing higher pressure in the higher pressure ranges. The following actual solution is demonstrated in FIG. 5.

FIG. 5 shows nine outlets, namely 21,121,221,321,421,521,621,721 and 821 which are operated by respective cylinder blocks as in the formerly discussed Figures. In the Figure the outlets 21,321 and 621 are combined in housing 19 to a third common flow 82 in outlet line 82. The outlets 121,421 and 721 are combined to a fourth common flow 83 in housing 19 and the outlets 221,521 and 821 are combined in housing 19 to a second common flow 81 in outlet line 81.

Instead of combining each three outlets into one of the common flows, any other plurality or singularity of outlets might be combined to a common outlet flow, depending on actual requirement.

FIG. 5 now shows the following operation in this embodiment of the invention:

A thrust loaded valve 85 is added to the housing 19, for example in a portion 90 thereof and one-endly loaded by thrust means 41 which might be a spring. In the first high-pressure range the pump 30 if one of my mentioned patented variable pumps, will supply the first variable outlet flow of for example, stepless variably until 4000 psi. At the maximum pressure of the pump 30 the outlet of the first common high pressure outlet flow will be reduced to the defined maximum of quantity of flow at the pressure-maximum of the first outlet flow. This quantity may then be also zero and a respective relief valve may be set at the maximum of pressure of the first outlet flow to protect the mechanical parts of the first outlet flow pump 30 from too high a pressure, which might otherwise disturb the mechanical parts of the first outlet flow pump 30.

As soon as the required pressure rises over the maximum pressure of the first outlet flow the valve 85 still holds the position as shown in FIG. 5. It now delivers at the second high-pressure outlet flow all outlet lines 81,82,83 through control recesses 86,87,98 and partially through medial bore 186 out of outlet 921. This is the second high pressure outlet stage with the second, now non-variable delivery outlet flow quantity. As soon as the pressure required rises, for example to the maximum pressure of the second high pressure outlet stage, for example 6000 psi, the valve 85 moves leftward against the thrust means or spring 41. Control recess 187 is now meeting control recess 86 and leads now the second outlet flow of line 81 into the low pressure or unloading chamber 89. Unloading chamber 89 may be communicated to the tank or to low pressure space 2 of the machine. The now remaining flows are outlet flows 82 and 83 which now supply a reduced flow quantity of the third high pressure delivery stage with a still higher pressure of for example 6000 to 8000 psi.

When the required pressure reaches the maximum pressure of the third outlet maximum pressure stage, for example, more than the said 8000 psi, the valve 85 moves still further leftward and communicates also control recess 188 with control recess 87 in addition to the already established communication between recesses 86 and 187. The second common outlet flow 82 is now led through recesses 87 and 188 into the unloading chamber 89. Thereby outlet flows 81 and 82 are led to the unloading chamber and are now cut off from the high pressure delivery port 921. The only remaining outlet flow is now the fourth common outlet flow 83. It flows out directly into and out of outlet 921 with the now smallest delivery outlet flow quantity but with the highest pressure range of for example 8000 to 10,000 psi. Thereafter the valve 85 might, if so desired, also act as a relief valve for the highest maximum pressure. That can be done by allowing it to move further leftward after the highest pressure of for example 10,000 psi is reached to communicate also outlet flow 83 to the unloading chamber 89. It is possible by the meeting of recess 88 with the unloading chamber 89.

The pressures of the discussion are samples only. By defining other thrusts, strengths or way-lengths of thruster 41, valve 85 and/or housing portion 90 with the respective control recesses, other ranges of high pressure stages can be defined. Instead of defining a first high pressure flow, second high pressure flow, third high pressure flow and fourth high pressure flow with the respective first to fourth pressure ranges, it is also possible to define any other number of high pressure flows and high pressure ranges. Instead of valve 85 and housing 90 any other suitable control arrangement may be utilized when the rules and aims of the invention are obeyed.

For a fully automatic operation of the principle, the outlet 21 of the first pump 30 may become combined with highest pressure outlet 921.

Figure 10:
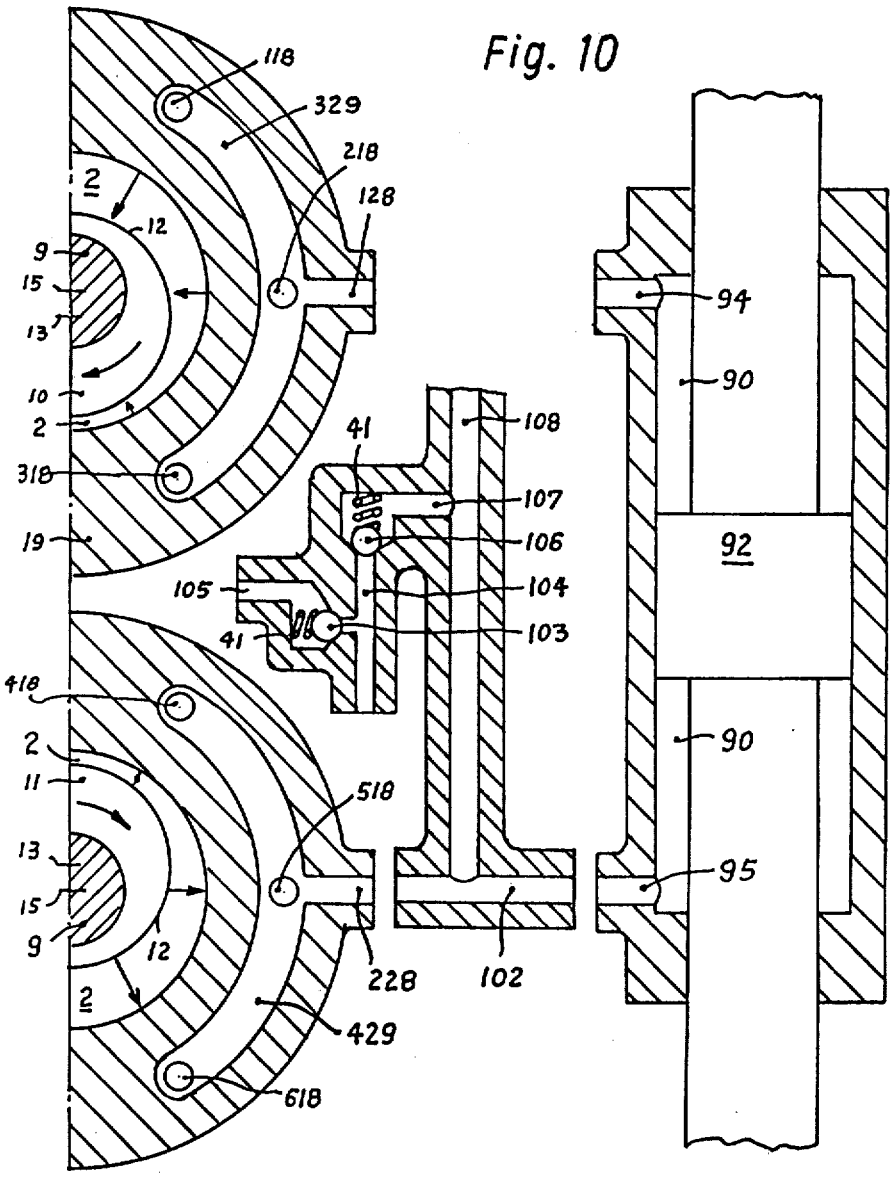
FIG. 10 is a schematic explanatory Figure and shows also cross-sectional views through portions of a respective embodiment of the invention.

FIG. 10 serves to demonstrate in the one plane of a schematic drawing, the operation of an exterior oscillator by the arrangement of the invention. The upper left portion of this figure shows by the arrows the direction of rotation of cam 10 and the direction of the piston strokes. It shows the pistons moving outwards in the cylinders and thereby toward the outer face 12 and into the second space 2. Collection chamber 329 communicates to exit ports 118,218,318. The bottom left portion of the Figure shows by the arrows the oppositional direction of movement of the pistons, namely inwards into the cylinders and thereby out of the second space 2. Collection chamber 429 communicates to exit ports 418, 518 and 618. The axes 15 of the shaft 9 and the eccenric axes 13 of the cam rings 10 or 11 are shown in the figure.

The left portion may either be the one and the other half of cam 10 and cylinder block 16 of FIG. 2 or different cams and cylinder blocks 10,11,16,116 of for example FIG. 3 or 6. Collection chamber 329 has port 128 and collection chamber 429 has port 228.

The exterior cylinder 90 has therein reciprocable or oscillable the piston 92 and it has ports 94 and 95.

By setting a passage from port 128 to port 94 and another passage from port 228 to port 95 the piston 92 will reciprocate with each full revolution of cam 10 or 10 and 11. Upwards during one half of a revolution and downward at the other half of the revolution of one cam or of two cams 10,11.

Fluid lines of samples are demonstrated by referentials 102,101,108,104,105. In order to adjust for probable leakages, undesired overpressures at temporary locations and the like, a valve or valves may be set into the fluid line passages or into the arrangement of one of the Figures of the specification. For example, as the Figure shows, valves 106 and/or 103 with loaders or springs 41 may be set as shown into fluid passage portions 105. Valve 106 prevents flow from line 108 into line 104 and valve 103 is a relief valve to line 104.

With the principle described for example at hand of FIG. 10, the arrangement of the invention of this embodiment may combine from a pumping arrangement to a driving and controlling arrangement. Thereby novel operation systems for machines or vehicle can be obtained. One example of such novel machine operation is explained in FIG. 11. But the system is not limited to this Figure and system.

Figure 11:
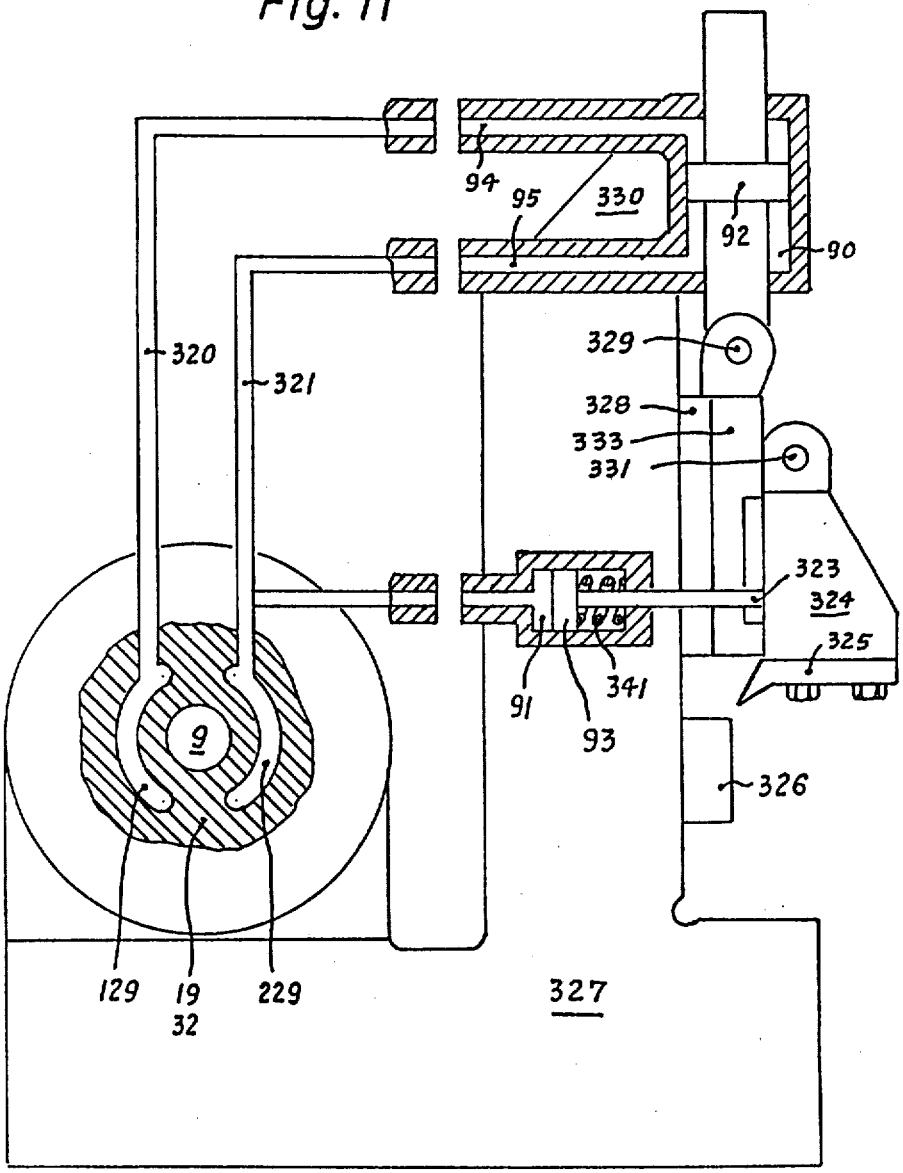
FIG. 11 is a view onto a machine operated by an embodiment of the invention, wherein partially cross-sectional views through portions of the invention are shown.

FIG. 11 sets the exterior cylinder 90 to a shaving or slotting machine 327 and fastens it by body 330 thereto. Piston 92 is fastened by connector 329 to sled 333 in slide bed 328.

Collection chamber 129 is communicated by fluid line 320 to port 94 and collection chamber 229 is communicated by fluid line 321 to port 95 of cylinder 90. Thus, when the arrangement of the invention operates, the respective cam 10,11 drives the piston 92 upwards and downwards periodically and thereby operates the slotter-knife or shaving-bite 325 over the material block 326 and cuts or shaves it as in the otherwise common shaving or slotting machine.

For several specific purposes, for example for the lifting away of bite 325 from material block 326 at the backwards stroke, an additional cylinder 91 may be set. It may contain a spring 341 at one end of piston 93. The cylinder chamber in cylinder 91 may be communicated by a passage to fluid line 321. Thereby, when pressure acts in line 321 the piston 92 moves the sled 333 upwards. But at the same time the pressure in line 321 and in cylinder 91 compresses the spring 341 and presses the piston shaft 323 against the liftable holder 324 and thereby bite or knife 325 away from the material block 326. The lifting capability is obtained by swing-connection 331 as otherwise usual in this kind of machines.

Thus, the machine of this embodiment of the invention can be operated exclusively by the flow supply and control arrangement of the invention without any further electronic, hydraulic, mechanic or other additional control facilities.

Figure 16:
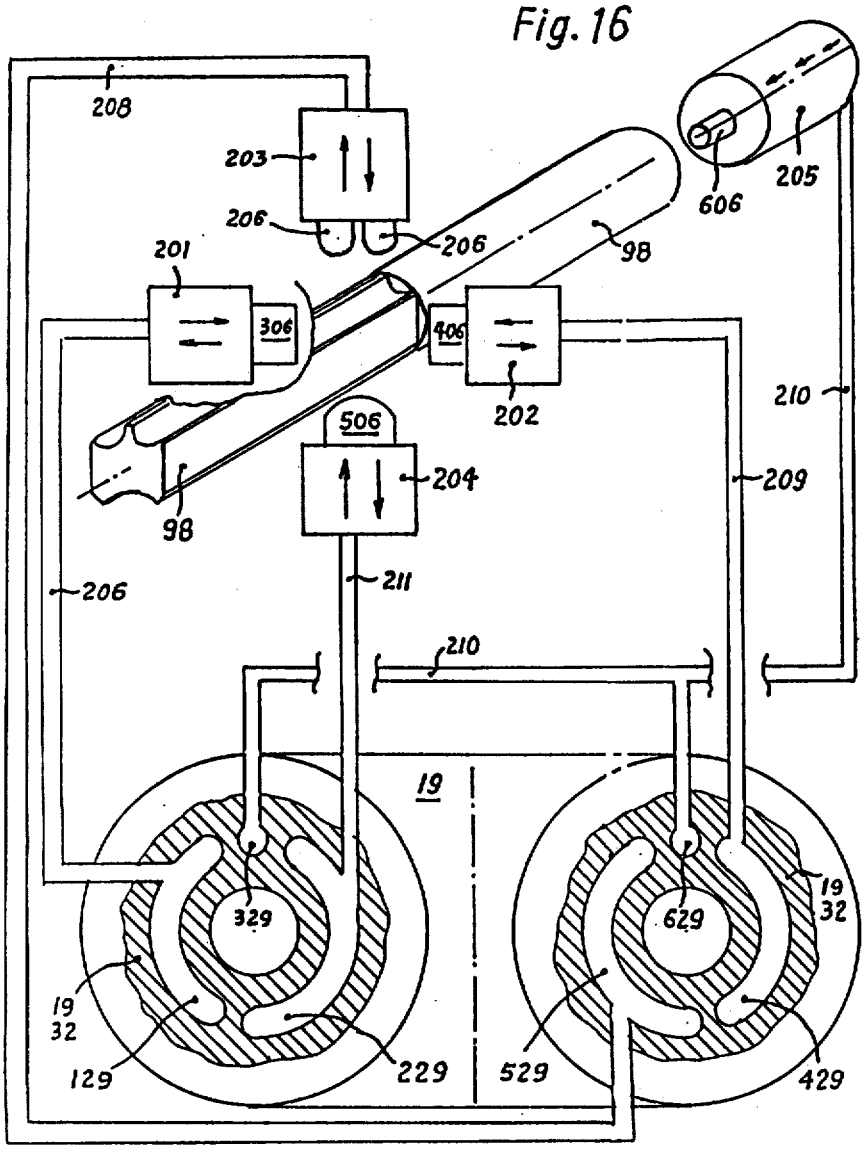
FIG. 16 demonstrates in a view onto it a still further embodiment of the invention, which is a profile making machine driven and operated by an embodiment of the invention and the Figure includes partially cross-sectional views through portions of the respective embodiment of the invention.

FIG. 16 demonstrates an even more useful novel machine of the invention. Housing 19 contains cylinder blocks 16 and 116 and cams 10 and 11 of FIG. 3 or FIG. 6. However, in the Figure of one plane of paper the outlets on the front and and those on the back end could not be shown. Therefore, the Figure demonstrates the arrangement of FIG. 3 or 6 cut radially in the middle and swung upwards, so, that in the one plane of the sheet of paper which contains the figure, the cross-sectional views through the collection chambers are shown. Cylinder block 16 may deliver into the collection chambers 129 and 229 by a respective number of communicated exit ports 18. One or more exit ports 18 may however deliver into collection chamber or outlet 329. Similarly the exit ports of cylinder block 116 may be connected to collection chambers 429,529 and 629. It may be noted, that it is not at all times necessary to connect equal numbers of exit ports to collection chambers. The Figure therefore shows wider collection chambers 229 and 429 for a greater number of connections of exit ports 18 and shorter collection chambers 129 and 529 for connection of a smaller number of exit ports 18 to the respective chamber for flow collection. And referentials 329 and 629 show either individual single outlets of each a single exit port 18 or of the smallest number of plural exit ports 18.

What counts in this Figure however, is, that collection chambers 229 and 429 are communicated to those exit ports of the respective cylinder block, which act equally at the respective time. And so are the collection chambers 129 and 529 as well as outlets 329 and 629. Outlet 329 communicates by fluid line 207, 210 to cylinder 205. Outlet 629 communicates by fluid line 210 also to cylinder 205. Lines 207 and 210 may communicated if so desired. Outlet 129 communicates to cylinder 201. Outlet 429 communicates to cylinder 202. Collection chamber 229 communicates to cylinder 204, and, collection chamber 529 communicates to cylinder 203. The cylinders may be for example those with springs, like cylinder 91 to FIG. 11. The communications may be otherwise if so desired. Fluid lines 206,208,209 and 211 show the last mentioned communications.

Cylinder 201 has piston head 306 and cylinder 202 as piston head 406. Both cylinders are mounted distanced from each other but on an equal axis and head to head. When now collections chambers 129 and 429 are acting in a supply cycle-portion, they are pressing piston heads 306 and 406 towards each other. They do so at the same time with the same strength. In the Figure this equally timed action of piston heads 306 and 406 is utilized to press or forge a profile onto the material bar 98. At the other half of the cycle the piston heads 306 and 406 are returning because collection chambers 129 and 429 are then acting as intake spaces and the springs in cylinders 201 and 202 now return the pistons 306 and 406.

At this time of the cycle, the collection chambers 229 and 529 are acting in the delivery cycle half. Thereby they are pressing the piston heads 206 and 506 towards each other. At this time the piston heads 206 and 506 are doing another profile pressing or profile forging action onto the bar 98. The cylinders 203 and 204 are respectively mounted in order to perform the profile producing action on the respective desired local places. At the next half of the cycle the piston heads 206 and 506 will return into their respective cylinders 203 and 204 because the collection chambers 229 and 529 are then intaking chambers.

In addition to the described cycles the outlet(s) 329,629 temporarily supply a fluid into cylinder 205. It is preferred here that outlets 329,629 are communicated to cylinders with exit port valves. Cylinder 205 now presses its piston 606 forward towards and against bar 98. Thereby bar 98 is moved forward. It may be noted, that piston 606 would in this arrangement move stepwise. The movement may be small.

Thus, in this figure piston heads 306,406 are doing a profile creation, piston heads 306,406 are doing a further profile creation thereafter, piston 606 supplies the stepwise transfer of bar 98 to the places of profile creation and this work is going on continually and automatically. Bar 98 is moved stepwise and in relation to the profile creating process continually more along the profile creation places until the entire bar 98 which might have been round originally, is created or formed to a multi-curved profile. This continuong process runs automatically exclusively by the arrangement of the invention without requiring any further electronic, mechanic, hydraulic or other control facilities.

It should be noted here, that bar 98 may not need any strong basis for support. Because it is not a single presser, which one-sidedly presses against the to be profiled bar, but it are alltimes diametrically or otherwise self-balancing located pistons which move from opposite or blanced directions at equal times against the to be profiled bar 98. Thus, bar 98 is substantially free from one sided loads. A support to carry its weight and guide its location and direction can be enough to provide a proper profiling procedure.

Figure 17:
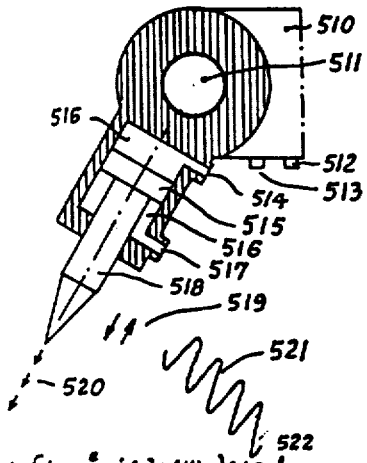
FIG. 17 is a longitudinal sectional view through still another embodiment of the invention which is in this case a vibration hammer with automatic advance and a schematic is added to explain the movement of the hammer and its movement-function.

FIG. 17 demonstrates in a schematic a power hammer which is an external piston in a external cylinder, driven by one of the embodiments of the arrangement of the invention. Piston 515 is reciprocated in cylinder 516 and extends from one end of the cylinder by hammer 518. Holder 510 can hold and transport the swingable hammer-cylinder 516. For example on a bulldozzer, car, power shovel or other convenient means. Exits ports and entrance-return flow ports 512,513 or more are provided on the holder 510 and are connected for example by flexible hoses or other fluid lines to the ports 514 and 517 on different ends of cylinder 516. While such hammers might have been used in the past, the specifity of the hammer of this Figure is, that the hammer 518 can be automatically reciprocated or oscillated by one of the arrangements of the invention. For example by that of FIGS. 3,6,7,10,11 or 16. In the Figure is also demonstrated, that an overlaying advance 520 can be added to the oscillation-movement. This is done for example by the outlets 77 and/or 78 of FIG. 7, or by 221 and/or 321 of FIG. 7, or by outlet 329 and/or 629 of FIG. 16. The actual movement of the hammer or piston 515–518 may then be the overlay of oscillation or reciprocation of vibration 519 and the stepwise advance 520. This gives a movement 521 of the sin-function of equation 522 plus the advance 520. The advance 520 could also be a continuous advance by FIG. 1 or like, if so desired. The movement in equation 522 is "Vk"; the rotary angular velicity is "$\omega$"; the angle of rotation from angle zero is "$\alpha$"; the radius of cam ring 10 or 11 with outer face 12 and thereby the radius of the outer face 12 is "R" and the eccentricity between the centric axis 15 and the eccentric axis 13 is "e". The advance is "$\Delta$Vimp". And the relation of the diameter of the respective piston 6 with the respective number of pistons 6 to the diameter of the piston 515 is: "Rel D $\phi$". Thus, the functions of the movement of piston and hammer 515,518 can be exactly determined by the respective embodiment of the invention, just as it is desired.

Figure 18:
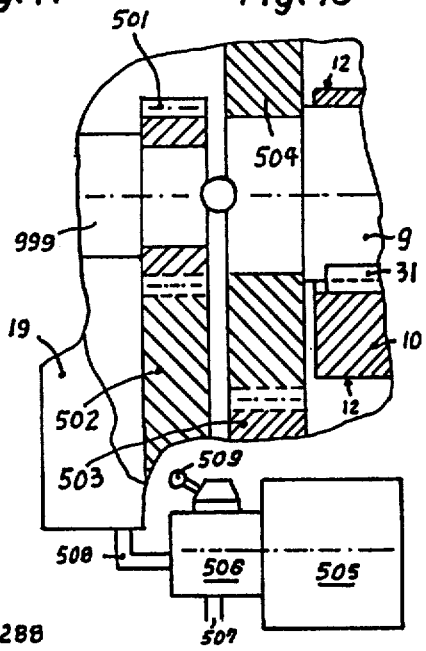
FIG. 18 is a longitudinal sectional view through still a further embodiment of the invention.

In FIG. 18 the embodiment of the invention is provided with a reduction gear between the motor and the right side arrangement of FIG. 4. First shaft 999 in the motor 68 of FIG. 4 drives the first gear 501, which in turn drives the second gear 502; second gear 502 drives the third gear 503 while the third gear 503 drives the fourth gear 504 which in turn drives the second shaft 9 which carries the respective eccentric cam ring 10 and/or 11 which with its outer face 12 drives and operates the pistons 6 of the arrangement together with the pressure in the first space 1 and with the inner pressure in the cylinder 5. The provision of the reduction gear 501 to 504, which might be any other suitable gear, is provided in order to make large strokes of the exterior piston or pistons possible by respectively larger strokes and eccentricities within the arrangement of the invention and by respectively larger diameters of the pistons 6 of the arrangement of the invention.

When, as shown in the Figure, a power source drives the variable first pump 506 with variable adjustment controller 509 for stepless variability of the rate of flow suctioned by suction line 507 and delivered by pressure fluid line 508 into the motor of FIG. 4, the arrangement of FIG. 4 will be able to supply respective variable flows or a variable flow of extremely high pressure, up to tenthousand psi or even more. Thereby the exterior cylinders, pistons, linear or rotary motors of the different embodiments of the invention can become operated steplessly variable.

Figure 19:
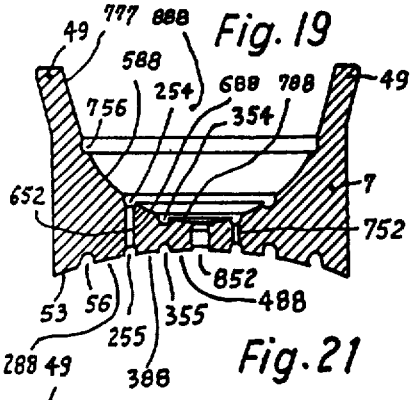
FIG. 19 is a longitudinal sectional view through a piston shoe of the invention.

FIG. 19 shows the piston shoe of FIG. 15 in a somewhat larger scale and in separated demonstration. It is shown in this Figure, that the piston shoe has between its radial extensions and guide extensions 49 the recess 888. This recess 888 is required, in order that the innermost portion of the cylinder bloc can enter into this recess, when the guide portions 49 pass or move along the guide faces 48 within recess 47 radially upwards beyond the innermost end of the cylinder bloc 16; of for example FIG. 15.

Figure 20:
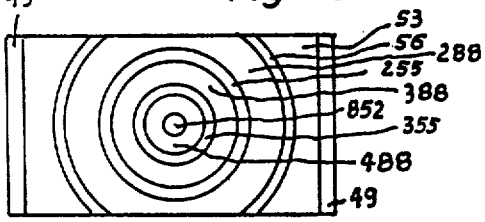
FIG. 20 is a view onto FIG. 19 from below FIG. 19.
Figure 21:
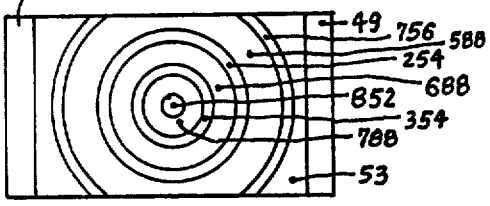
FIG. 21 is a view onto FIG. 19 from above FIG. 19.

FIG. 20 shows the shoe 7 of FIG. 19 seen from below and FIG. 21 shows it seen from above. It is seen now in these Figures, and in FIG. 19, that the unloading recess 56 in the bottom and 756 in the upper portion of the piston shoe may, when the shoe is small in axial direction parallel to the centric axis 15 of the shaft 9, the mentioned unloading recesses 56 and 756, directly communicate to the low-pressure space 2 by extending out of the respective guide face 53,588 of the piston shoe 7. The fluid pressure balancing pockets 54 and 55 of FIG. 15 are in FIGS. 19 to 21 divided into pluralities of fluid pressure balancing pockets or recesses 254,354 and 852 as well as 255,355 and 852. The respective pockets or recesses with end digits 54 and 55 may be communicated with each other by respective passages 652,752, while recesses with end digits 54 or 55 may be communicated with each other by respective small passages which are not shown in the Figure. Because they might also be located in the piston head or face 806. Instead of providing the fluid-pressure balancing pockets or recesses with end digits 54 in the piston shoe 7, they might also be provided through the seat face 806 into the respective piston head 806 of the respective piston 6.

It is important in this Figure, that between the respective recess-portions with end digits 54 or 55 and recess or passage 852 the bearing lands or bearing faces with end digits 88 occur. The bearing faces or bearing lands 688,788,388,488 are lubricated by high pressure each from two ends out of the respective recess portions 354,354,852;255,355 and/or 852. By this lubrication from two ends, they are receiving a capability to bear and lubricate at very high pressures with very high radial bearing force capacity. There are also bearing lands or bearing faces 588 and 288 provided. There are however at the same time sealing faces or sealing lands, which seal the outer fluid pressure pocket portions 254 and 255 against the unloading recesses 756 and 56. They are pressure-lubricated only from one end, namely from pocket portions 254 and 255. The dimensioning of these seal faces or sealing lands 288 and 588 is very important for the proper functioning at high pressure. Their outer ends, where the unloading recesses 756,56 are beginning, should be of only a small percentage bigger in diameter than the diameter of the respective associated piston 6. How much bigger in diameter will depend on the diameter of the begin of the sealing land 588,288 at the outer end of the balancing recess 254,255 and also on the size of the radius or radii of piston head 806 with face 806 and faces 588,688,788 of piston shoe 7.

The arrangements to the cylinder blocks may also be defined, as follows:

A hydraulic arrangement, including in combination, a housing 19, a rotary shaft 9 revolvably borne in said housing 19, at least one eccentric cam ring 10,11 revolving in unison with said shaft 9 when said shaft 9 revolves, surrounding a portion of said shaft 9 and forming a cylindrical outer face 12 of equal radii around an axis 13 which is parallel to the axis 15 of said shaft 9 but distanced therefrom by a first eccentricity 613,713; at least one cylinder block 16,116 provided in said housing 19 and facilitating at least one cylinder 5, at least one piston 6, at least one entrance port 17 and at least one exit port 18 to pass fluid into and out of said at least one cylinder 5 when said at least one piston 6 reciprocate in said at least one cylinder 5; while said housing 19 also includes at least one first space 1 and at least one second space 2, at least one inlet 20 and at least one outlet 21; said second space 2 is sea-led and separated from said first space 1; said first space engages said at least one entrance port 17, said outlet 21 communicates to said at least one exit port 18; said second space 2 surrounds said at least one cam ring 10,11; said at least one pistion 6 is capable of partially entering said second space 2 and engaging at least indirectly said outer face 12 of said cam ring 10,11, and said outer face 12 of said cam ring 10,11 is at least indirectly engaging to guide at least partially the reciprocation-stroke of said at least one piston 6 when said at least one piston 6 reciprocates in said at least one cylinder 5, wherein said first space 1 is supplied with a first pressure 1 and said second space 2 is communicated to a space i.e. 20, of a second pressure;

wherein said second pressure is substantially lower than said first pressure;

wherein said first pressure presses through said at least one entrance port 17 into said at least one cylinder 5 and against one end of said at least one piston 6, and, wherein said piston 6 is pressed by said first pressure towards said outer face 12 of said eccentric cam ring 10,11 and at least into indirect engagement with said outer face 12 of said cam ring, 10,11, and; or;

wherein a piston shoe 7 is interposed between the head 806 of said piston 6 and said outer face 12 of said cam ring; 10,11;

wherein a minimum inner pressure valve 51 is mounted in said piston 6 and communicated to a passage 52 which extends through said piston 6 from said cylinder 5 to said piston shoe, 7, wherein said inner pressure valve 51 closes said passage 52 through said piston 6 at any pressure below the minimum setting pressure of said inner pressure valve 51 but opens toward the piston shoe 7 at any pressure exceeding said minimum inner pressure, wherein said piston shoe 7 is provided with at least one fluid pressure pocket 54,55 and at least one unloading recess, 56, wherein said at least one fluid pressure pocket 54,55 is communicated to said passage 52 through said piston 6 and to said inner pressure valve 51, wherein said unloading recess 56 is communicated by a respective passage to 56,57 to said second space 2 in said housing, 19, wherein at least one of said fluid pressure pockets 54,55,254,354,255,355,852 is closed radially by said outer face 12 of said cam ring, 10,11 wherein said piston 6 forms a piston head 806 outwards of said cylinder 5 and directed towards said piston shoe, 7, wherein said piston shoe 7 forms a first slide face 53,288,388,488, engaging said outer face 12 of said cam ring 10,11 and a second slide face 588,688,788 which forms a bearing bed 588 on the opposite end of said first slide face 53 of said piston shoe, 7, wherein said bearing bed 588 and its second slide face 588,688,788 are forming a part of a hollow ball of equal radii 888 around a swing center; 800;

wherein said piston head forms a head face 806 of a configuration complementary to said second slide face and bearing bed 588 with radii 888 substantially equal to said radii and around said swing center, 800, wherein said piston head 806 engages said bearing bed 53 and said piston 6 and piston shoe 7 are capable of pivoting around said swing center, 800, wherein said first pressure 1 presses said piston head 806 against said bearing bed 588 at closed position of said inner valve 51 and maintains the engagement of said piston head 806 and of said bearing bed 588, and, wherein said cam 10,11 at an other portion of the rotation of said cam 10,11 and of said shaft 19 slides with its outer face 12 along said first slide face 53 of said piston shoe 7, presses over said piston shoe 7 and piston head 806 said piston 6 inwards in said cylinder 5, whereby said inner valve 51 opens and permits pressure from said cylinder 5 into said pocket, 54,55 etc;

whereby said piston 6 supplies a flow of fluid of a fourth pressure through said exit port 18 and said outlet 21 out of said arrangement; 19; and; or;

wherein said inner pressure setting is at least of so high a pressure, that the product of the cross-sectional area of said piston 6 multiplied by said inner pressure setting supplies and exerts on the bottom of said piston 6 in said cylinder 5 a force which exceeds the friction of the outer face of said piston 6 along the inner wall of said cylinder 5, the resistance of said piston 6 and of said piston shoe 7 to acceleration, the resistance of slide friction of said piston shoe 7 along said outer face 12 of said cam ring 10,11 and the resistance of said piston shoe 7 against acceleration and the lateral forces appearing from said bed 53 and said head 806 onto said shoe 7 and onto said piston, 6, whereby said piston 6 remains at all times of its rest and of its reciprocation in said cylinder 5 under said force with its head 806 engaged in said bed 53 of said piston shoe 7 and said first slide face 53 of said piston shoe 7 on said outer face 12 of said cam ring, 10,11, wherein said cylinder block 16,116 has a reception recess 47 on its radially innermost portion for the partial reception of said piston shoe, 7, said reception recess 47 includes radial extensions 47 laterally of said cylinder 5 and extending radially outwardly beyond the radially innermost portion of said cylinder, 5, wherein said cylinder block 16,116 has radially inwardly extending guide portions 16 extending radially inwardly beyond said innermost portion of said cylinder 5 and forming guide faces 48 on said reception recess 47 laterally of said cylinder 5 which extend radially inwardly and outwardly beyond said innermost portion of said cylinder, 5, wherein said piston shoe 7 has radially outwardly extending guide parts, 49, laterally of said bearing bed 53 of a dimension smaller than the distance between said guide faces 48 of said reception recess, 47, wherein at least said guide parts 49 of said piston shoe 7 are located at all times within said reception recess 47 while this arrangement together with end members 24,25 axially of said recess 47 prevent accidental escape of said shoe 7 out of said reception recess 47 but said engagement of said head 806 and of said bearing bed 588 is maintained by said first pressure and the said fourth pressure of said flow of fluid which is delivered by said piston 16, and, wherein said at least one fluid pressure pocket 54,55 is so properly dimensioned that said shoe 7 and piston 6 are capable of pressures exceeding three thousand pounds per square inch at good efficiency without excessive leakage and friction.

For proper functioning of high pressure operation of piston shoe 7 and of piston 6, not only piston shoe 7 and the inner valve 51 of FIG. 15 are very important, but also the size of the third or first pressure in the first space 1 in relation to the mass and weight of the inlet valve 17 of FIG. 15, the resistance of the outer face of piston 6 on the inner face of cylinder 5; the cross-sectional area of the sum of the channels 45 in the entrance valve 17, the size of axial move-ability of entrance valve 17 in inlet valve housing 44 and the flexibility and strength of the loading spring means 844 of FIG. 1. When all these matters are properly applied, the device will function properly, securely and with a good efficiency even at very high pressures in the outlet flows or in the outlet flow. For details of the actual design and manufacturing drawings the inventor might be contacted at his permanent residence which is given at the first page of this patent specification.

Figure 22:
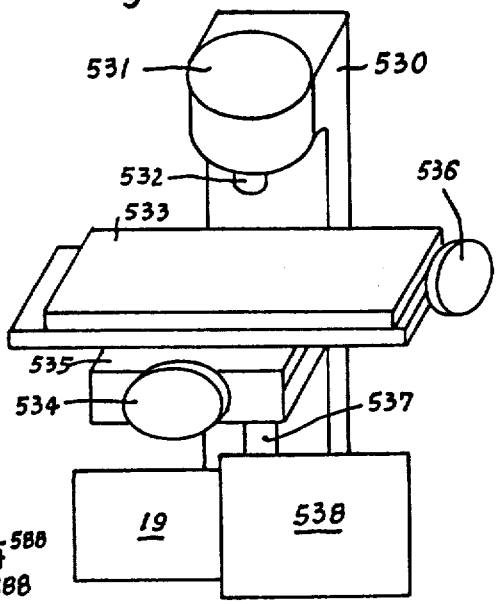
FIG. 22 is a view onto another embodiment of the invention, which is a machine which is operated by an embodiment of the invention and which includes stepwise and continually operated rotary and linear motors.

FIG. 22 demonstrates in a view onto it one of many possibilities of operating new machines or known machines or vehicles by one or more of the arrangements of the invention and thereby to obtain novel operation principles. The power source 538 may drive the arrangement 19 of the invention which then has fluid lines from its respective outlets to the respective motors 537,534, 536,531 of the figure. The fluid lines are however not shown in this figure, because the connection of fluidlines is already explained in others of the figures by ways of example. Exterior motor 531 may be a rotary motor and drive and control shaft 532 by rotary angular steps in timed relation or continually. Motor 536 may also be a rotary motor and operate the table 533 by rotary angular steps in timed relation or continually in one of both directions of rotation. Similarly the motor 534 may also be a rotary motor and may operate table 535 by rotary angularily defined steps or continually also in both rotary directions. Motor 531 may also operate in both rotary directions. Motor 537 may be a linear motor, which means a piston in a respective cylinder, which also may operate in axial step-movements or continually in both axial directions. The motors 531,536, 534 and 537 are exterior motors in the sense of the specification and its embodiments.

The patent specifications show some of the examples of the possible embodiments of the invention. More different applications and embodiments are possible and inquiries may be directed to the permanent residence of the inventor. Of extreme importance in the invention is, that the second space must be communicated to a low pressure space or contain a lower pressure than the first space 1. When the respective communication of low pressure provision is not provided, the mistake of U.S. Pat. No. 3,874,271 would be repeated and the arrangement can then not properly operate. At least not over a considerable time.

What is claimed is:

1. A hydraulic arrangement, including in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring at least indirectly engages to guide at least partially the reciprocation-stroke of said at least one piston when said at least one piston reciprocates in said at least one cylinder, wherein said first space is supplied with a first pressure and said second space is communicated to a space of a second pressure;

wherein said second pressure is substantially lower than said first pressure;

wherein said first pressure presses through said at least one entrance port into said at least one cylinder and against one end of said at least one piston, wherein said piston is pressed by said first pressure towards said outer face of said eccentric cam ring and at least into indirect engagement with said outer face of said cam ring;

wherein a piston shoe is interposed between the head of said piston and said outer face of said cam ring;

wherein a minimum inner pressure valve is mounted in said piston and communicated to a passage which extends through said piston from said cylinder to said piston shoe, wherein said inner pressure valve closes said passage through said piston at any pressure below the minimum setting pressure of said inner pressure valve but opens toward the piston shoe at any pressure exceeding said minimum inner pressure, wherein said piston shoe is provided with at least one fluid pressure pocket and at least one unloading recess, wherein said at least one fluid pressure pocket is communicated to said passage through said piston and to said inner pressure valve, wherein said unloading recess is communicated by a respective passage to said second space in said housing, wherein at least one of said fluid pressure pockets is closed radially by said outer face of said cam ring, wherein said piston forms a piston head outwards of said cylinder and directed towards said piston shoe, wherein said piston shoe forms a first slide face engaging said outer face of said cam ring and a second slide face which forms a bearing bed on the opposite end of said first slide face of said piston shoe, wherein said bearing bed and its second slide face are forming a part of a hollow ball of equal radii around a swing cent;

wherein said piston head forms a head face of a configuration complementary to said second slide face and bearing bed with radii substantially equal to said radii and around said swing center, wherein said piston head engages said bearing bed and said piston and piston shoe are capable of pivoting around said swing center, wherein said first pressure presses said piston head against said bearing bed at closed position of said inner valve and maintains the engagement of said piston head and of said bearing bed, and, wherein said cam at an other portion of the rotation of said cam and of said shaft slides with its outer face along said first slide face of said piston shoe, presses over said piston shoe and piston head said piston inwards in said cylinder, whereby said inner valve opens and permits pressure from said cylinder into said pocket, whereby said piston supplies a flow of fluid of a fourth pressure through said exit port and said outlet out of said arrangement.

2. The arrangement of claim 1, wherein said inner pressure setting is at least of so high a pressure, that the product of the cross-sectional area of said piston multiplied by said inner pressure setting supplies and excerts on the bottom of said piston in said cylinder a force which exceeds the friction of the outer face of said piston along the inner wall of said cylinder, the resistance of said piston and of said piston shoe to acceleration, the resistance of slide friction of said piston shoe along said outer face of said cam ring and the resistance of said piston shoe against accelleration and the lateral forces appearing from said bed and said head onto said shoe and onto said piston, whereby said piston remains at all times of its rest and of its reciprocation in said cylinder under said force with its head engaged in said bed of said piston shoe and said first slide face of said piston shoe on said outer face of said cam ring, wherein said cylinder block has a reception recess on its radially innermost portion for the partial reception of said piston shoe, said reception recess includes radial extensions laterally of said cylinder and extending radially outwardly beyond the radially innermost portion of said cylinder, wherein said cylinder block has radially inwardly extending guide portions, extending radially inwardly beyond said innermost portion of said cylinder and forming guide faces on said reception recess laterally of said cylinder, which extend radially inwardly and outwardly beyond said innermost portion of said cylinder, wherein said piston shoe has radially outwardly extending guide parts laterally of said bearing bed, of a dimension smaller than the distance between said guide faces of said reception recess, wherein at least said guide parts of said piston shoe are located at all times within said reception recess, while this arrangement together with end members axially of said recess prevent accidental escape of said shoe out of said reception recess but said engagement of said head and of said bearing bed is maintained by said first pressure and the said fourth pressure of said flow of fluid which is delivered by said piston, and, wherein said at least one fluid pressure pocket is so properly dimensioned that said shoe and piston are capable of pressures exceeding three thousand pounds per square inch at good efficiency without eccessive leakage and friction.

* * * * *